US006235367B1

(12) United States Patent
Holmes et al.

(10) Patent No.: US 6,235,367 B1
(45) Date of Patent: May 22, 2001

(54) COMPOSITE MATERIAL FOR CONSTRUCTION AND METHOD OF MAKING SAME

(75) Inventors: Robert D. Holmes; Valerie L. Holmes, both of 913 Glenwood Way, Escondido, CA (US) 92026; Frank J. McManus, Escondido, CA (US)

(73) Assignees: Robert D. Holmes; Valerie L. Holmes, both of Escondido, CA (US)

( * ) Notice: Subject to any disclaimer, the term of this patent is extended or adjusted under 35 U.S.C. 154(b) by 0 days.

(21) Appl. No.: 09/224,462

(22) Filed: Dec. 31, 1998

(51) Int. Cl.[7] ..... B32B 3/02; B32B 3/26; B32B 7/08

(52) U.S. Cl. ..... 428/45; 52/309.4; 52/309.7; 428/52; 428/61; 428/81; 428/223; 428/304.4

(58) Field of Search ..... 428/45, 52, 61, 428/81, 223, 304.4; 52/309.4, 309.7

(56) References Cited

U.S. PATENT DOCUMENTS 4,363,882 12/1982 Wegner .
4,572,865 * 2/1986 Gluck et al. ..... 428/309.9
4,772,676 9/1988 Koch et al. .
4,939,182 7/1990 Marugg et al. .
5,695,870 * 12/1997 Kelch et al. ..... 428/318.4

* cited by examiner

*Primary Examiner*—Blaine Copenheaver
(74) *Attorney, Agent, or Firm*—Ezra Sutton

(57) ABSTRACT

A molded construction product, having one or more walls and an inner core section, including a composition matrix having a resin system, a catalytic agent, and filler compounds for forming the walls; a foam core system for forming the inner core section, a curing agent and a drying agent. The resin system is for providing mechanical and physical characteristics of hardness and rigidity to the exterior walls of the molded product. The catalytic agent is for activating the reaction for the polymerization of the resin system. The filler compounds for reinforcing the walls. The foam core system is for producing the inner core section having three-dimensional cross-linking and a core density of 3.5 pounds per cubic foot. The curing agent is for cross-linking of polymers within the resin system for forming the exterior walls to be hard, rigid, and infusible. The drying agent is for drying and binding of excessive moisture within the composition. A structural reinforcement support system is provided for reinforcing the structural integrity of the composition. A locking system is provided for joining one or more of the molded products.

34 Claims, 14 Drawing Sheets

CAST MOLDING PROCEDURE

400

410

STEP 1
EXAMINING/INSPECTING/CLEANING/PREPPING

The first and second mold sections 122 and 142 of the molding tool 120 are examined and inspected to check if molding tool 120 is in proper working order. The molding tool 120 is then final cleaned with acetone to remove any leftover debris from the previous casting after an initial cleaning with acetone had been performed. An appropriate inner molding form 136 and/or 156 is attached to the inner wall surface 124is and/or 144is of the interior mold cavity 134 and/or 154 for making a replicated custom surface, if desired.

420

STEP 2
SPRAYING OF RELEASING AGENT

Each of the inner molding members 136 and/or 156 (if attached to mold sections 122 and/or 142) are sprayed with a releasing agent such as Aqualift™, such that each of the sides 42, 44, 46a to 46 of the molded product are released from the molding tool 120 upon completion of the molding process.

430

STEP 3
APPLYING AND CURING OF RESIN SYSTEM 50 WITH FILLER COMPOUND 52 AND REINFORCING MATERIALS

Simultaneously applying a resin system 50 which is a mixture of a resin compound, a filler compound 52 (for forming the texture, color and configuration of the replicated custom surface), reinforcing materials, and a catalyst. The resin system 50 is hand applied, injected or sprayed into each of the interior mold cavities 134 and 154 up to a depth of 0.5 inches and allowed to cure for up to 2 to 3 minutes. The resin system 50 is also applied to the side walls 126, 128, 130, 132, 146, 148, 150 and 152 to a thickness of 0.5 inches and allowed to cure for up to 2 to 3 minutes.

FIG. 15A

440

STEP 4
INSERTING AND PLACING OF THE NON-CHEMICAL ENTITIES

442

4A: PLACEMENT OF THE LOCKING SYSTEMS 80 which are in the form of cam locks 82, snap lock systems 83; slip fit lock systems; a track and ball lock system; a tension bolt and rod lock system; a hook bolt lock system; friction lock systems, and the like at predetermined locations adjacent to the side walls of the lower interior mold cavity 154, such that these locking systems 80 are positioned within the center core section 49 and adjacent to the side walls of the second molding section 142 appropriately. The placement of locking systems 80 is done before the resin cures.

444

4B: PLACEMENT OF THE STRUCTURAL REINFORCEMENT SUPPORT SYSTEMS 70 which are in the form of steel, iron or plastic rebar or rods, or fiberglass roving, strips etc. at predetermined locations within each of the interior mold cavities 134 and 154, such that these internal structural supports are positioned within the center core section 49 of the composition matrix 40.

450

STEP 5 (OPTIONAL)
SPRAYING OF RESIN SYSTEM 50 WITH FIBERGLASS

For additional strength, as an option, reinforcing wire mesh may be applied to the mold cavity 154. If so, an additional mixture of the resin system 50 with fiberglass is applied within the mold cavity 154 of the second mold section 142 in order to cover and hold the reinforcing wire mesh in place. This additional application of resin system 50 with fiberglass is allowed to cure for about 2 to 3 minutes.

FIG. 15B

460

STEP 6
POURING OF FOAM CORE SYSTEM 60

A mixture of the foam core system 60 is poured into one corner area within the interior mold cavity 154 of the second mold section 142. The foam core is 50% by weight of polymeric diphenylmethane 4,4 diisocyanate and 50% by weight of polymeric polyurethane resin.

470

STEP 7
CLOSING AND CLAMPING OF MOLD TOOL 120

The first mold section 122 is closed and clamped shut to the second mold section 142 of molding tool 120. The foam core within the composition matrix 40 is allowed to expand and cure for 18 to 20 minutes.

480

STEP 8
OPENING AND UNCLAMPING OF MOLD TOOL 120

The first mold section 122 is unclamped and opened from the second mold section 142, such that the finished casted exterior wall panel 12ew is then removed from the interior mold cavity 154 of the second mold section 142, thus completing the molding of wall panel 12ew.

FIG. 15C

COMPOSITE MATERIAL FOR CONSTRUCTION AND METHOD OF MAKING SAME

FIELD OF THE INVENTION

This invention relates to a construction composite material used in the manufacture of molded panels used for interior wall erecting panels, exterior wall panels, facade facings and roofing panels for the building of houses, commercial businesses, and industrial facilities, as well as the manufacture of power transmission poles, railroad ties, conduits, sewage piping, insulation barriers for protecting hulls, bulkheads, overheads, and compartments of ships, aircraft, railway tanker cars, tanker trucks, and the like. More particularly, the construction composite material is a bonded composition matrix that includes the unique combination of chemical components having support structures (non-chemical) therein.

BACKGROUND OF THE INVENTION

The demand for housing, electrical power, and sewage removal on a global scale is great. On the continents of South America, Asia, Africa and Eastern Europe the needs are highest. Many people in these areas are without any shelter, electrical power or sewage facilities at all. Where shelter is provided, and/or power and sewage removal, it is usually unsafe, unsanitary and sub-standard even by the lowest possible basic considerations.

Many of these governments and private sector industries cannot meet the demand for these basis improvements. Whether it is due to lack of resources, manpower or technology, they could not even come close to supplying all the housing, electrical power and sanitary sewage facility needs in their respective countries. Then, in an attempt to reduce this problem, they simply build unsafe housing.

There remains a need in these countries for modern day construction of housing and buildings, electrical power and sanitary sewage techniques and materials. Especially, a composite material product that will minimize the use of natural resources, one that is safe, can survive natural disasters, and is able to be built efficiently and timely. Additionally, there is a need to provide the process technology for the manufacturing of such products in underdeveloped countries by producing more efficient building materials.

DESCRIPTION OF THE PRIOR ART

Construction materials having chemical components that include an isocyonate, a styrene, a hydroxyl terminated poly oxyalkylene, an amine curing compound and/or a form of benzene have been disclosed in the prior art. For example, U.S. Pat. No. 4,363,882 to WEGNER discloses a composition that is used as a flame retardant polyurethane foam. This prior art patent does not disclose or teach the particular composition of the present invention.

U.S. Pat. No. 4,772,676 to KOCH et al discloses a polyisocyanate polymer having good flame retardant properties. This prior art patent does not disclose or teach the particular composite material of the present invention.

U.S. Pat. No. 4,939,182 to MARUGG et al discloses a composition that is used for the patching and repairing of rubber tires for vehicles. This prior art patent does not disclose or teach the particular composite material of the present invention.

None of the aforementioned patents disclose or teach the composite material for construction in the manufacture of panels, power transmission poles, conduits, or insulation barriers of the present invention.

Accordingly, it is an object of the present invention to provide a composite material for construction used in the building and construction of personal dwellings/houses, commercial businesses, and industrial facilities, wherein such construction composite products include foundations, building pads, interior wall erecting panels, exterior wall panels, facade facings, roofing panels, mortarless building blocks, conduits, columns, sewage piping, manholes, manhole covers, septic tanks, insulation barriers, fire rated acoustical panels and the like.

Another object of the present invention is to provide a composite material for construction used in the manufacture of power transmission poles, utility poles, overhead lighting poles; sewage facility infrastructure piping, and septic tanks; railroad ties; pallets; spacers; insulation barriers for protecting hulls, bulkheads, overheads, and compartments of ships, aircraft, railway tanker cars, tanker trucks, military vehicles (i.e. tanks) and the like; piers and docks; pylons; dolphins; buoys; and chemical storage tanks.

Another object of the present invention is to provide a composite material for construction that is a bonded composition matrix which includes a unique combination of chemical components having integral support structures (non-chemical) therein for an improved method of manufacture of panels, transmission poles, conduits, piping, insulation barriers and the like.

Another object of the present invention is to provide a composite material for construction used in the building construction of site accessories such as streets, walkways, fencing, outdoor benches and tables, playground equipment (swings, jungle gyms, seesaws and the like); and overhead lighting poles.

Another object of the present invention is to provide a composite material for construction that gives excellent production of custom surfaces, textures and colors in replicating such construction products as wood, brick, cinder block, stone, cement, metal finishes, ceramic tile, stucco, roofing shingles, siding, marble flooring and the like.

Another object of the present invention is to provide a composite material for construction that has a performance index level superior to that of construction materials such as concrete, steel, wood, brick and cinder block for compressive, tensile, flexural and shear strengths.

Another object of the present invention is to provide a composite material for construction that has a compressive strength to weight ratio greater than 95,000 and a R factor greater than 25 (R factor is the measure of the thermal resistance of the material for the passage of heat therethrough (hr-ft$^2$-° F./BTU).

Another object of the present invention is to provide a composite material for construction that reduces product manufacturing costs due to more efficient process production methods.

Another object of the present invention is to provide a composite material for construction that will increase product distribution efficiency due to increased trucking capacity in carrying lighter weight components.

Another object of the present invention is to provide a composite material for construction that reduces product weight to below 130 pounds per cubic foot due to new and improved manufacturing methods in order to decrease product shipping costs due to lighter weight components.

Another object of the present invention is to provide a composite material for construction that will increase cash flow due to increased production rates in the manufacturing of the composite material products in using the new and improved manufacturing methods of the present invention.

Another object of the present invention is to provide a composite material for construction that will increase profits through the use of more cost effective products made from the composite material of the present invention.

A still further object of the present invention is to provide a composite material for construction that can be mass produced in an automated and economical manner and is readily affordable by the construction user.

SUMMARY OF THE INVENTION

In accordance with the present invention there is provided a composition for making a molded construction product, having one or more walls and an inner core section. The composition includes a composition matrix having a resin system, a catalytic agent, and filler compounds for forming walls; a foam core system for forming the inner core section; a curing agent and a drying agent. The resin system is for providing mechanical and physical characteristics of hardness and rigidity to the walls of the molded product, the resin system having a range of 5.00% to 60.0% by weight of the composition. The catalytic agent is for activating the reaction for the polymerization of the resin system, the catalytic agent having a range of 0.50% to 30.0% by weight of the composition. The filler compounds have a range of 5.0% to 80.0% by weight of the composition. The foam core system is for producing the inner core section having three-dimensional cross-linking and a core density of 3.5 pounds per cubic foot, the foam core system having a range of 5.0% to 70.0% by weight of the composition. The curing agent is for cross-linking of polymers within the resin system for forming the walls to be hard, rigid, and infusible, the curing agent having a range of 10 ppm to 3.00% by weight of the composition. The drying agent is for drying and binding of excessive moisture within the composition, the drying agent having a range of 10 ppm to 10.0% by weight of the composition. A structural reinforcement support system for reinforcing the structural integrity of the composition matrix of the material composition. A locking system is provided for joining together one or more of the molded products.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein;

FIG. 15A is a block diagram of the method of the cast molding procedure for producing a molded product such as an exterior wall panel showing the steps of examining and inspecting the molding tool; spraying of a releasing agent within the mold cavity of the molding tool; and applying of the resin system within the molding tool in performing the molding process of the present invention;

FIG. 15B is a block diagram of the method of the cast molding procedure for producing a molded product such as an exterior wall panel showing the steps of inserting and placing of the locking systems and the internal structural reinforcement support systems within the mold cavity of the molding tool; and spraying of the resin system with fiberglass (optional) within the molding tool when reinforcing wire mesh is applied to the mold cavity that are performed in the molding process of the present invention; and FIG. 15C is a block diagram of the method of the cast molding procedure for producing a molded product such as an exterior wall panel showing the steps of pouring of the foam core system with the molding tool; closing and clamping of the molding tool; and opening and unclamping of the molding tool for the removal of a formed and molded exterior wall panel that are performed in the molding process of the present invention.

DETAILED DESCRIPTION OF THE PREFERRED EMBODIMENT

Figure 1:
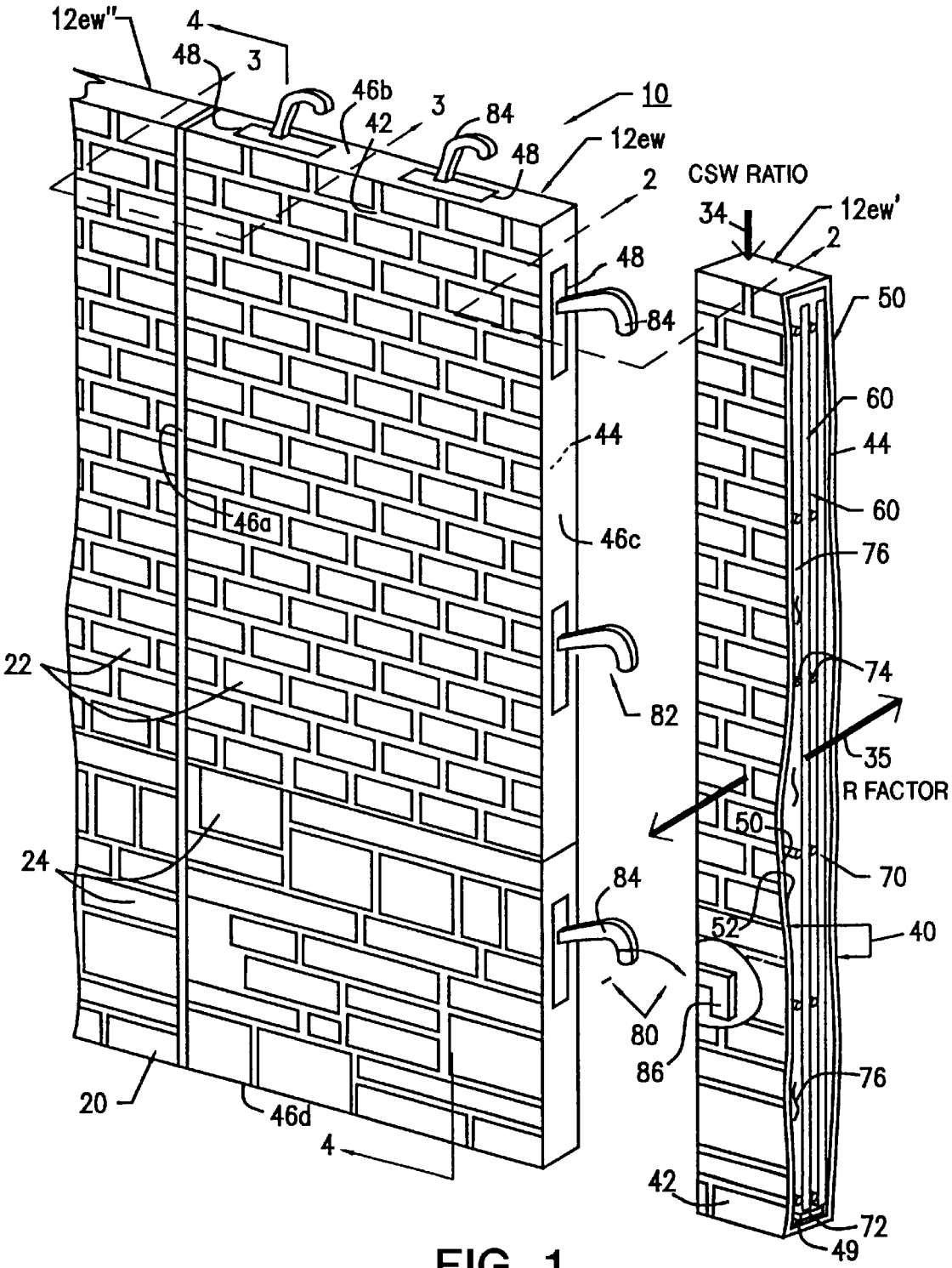
FIG. 1 is a front perspective view of the composite material for construction of the preferred embodiment of the present invention showing an exterior wall panel having an exterior custom replicate surface of brick and stone, and a cam lock system for joining together to a second exterior wall panel.

The composite material 10 for construction of the preferred embodiment of the present invention is represented in detail by FIGS. 1 through 14 of the drawings. The constituent components include chemical components and non-chemical components in the form of structural internal supports within the bonded composition matrix 40. The chemical components include a resin system 50, a catalyst, a filler, a foam core system 60 for the structural core, a curing agent and a drying agent. The non-chemical components include structural reinforcement support systems 70 and locking systems 80.

In the preferred invention, the composition of the composite material 10 is as follows:

TABLE A

| COMPONENT COMPOUND | % COMPONENT WEIGHT OVERALL RANGE |
|---|---|
| CHEMICAL ENTITIES | |
| I. Resin system compounds include polyesters; polyolefins; polystyrenes; polyvinyl chlorides; polyethylenes and other polymers and co-polymers of ethylene; acrylonitrilebutadiene-styrene copolymers; polyurethanes; poly-propylenes; polycarbonates; polyamides; poly-imides; polysulfones; polyaromatic oxides; nylons; styrene 1,2,4-trimethylbenzene; and equivalents and combinations thereof. | 5.00% to 60.0% |
| II. Catalytic agents include cobalt, sodium chloride, methyl ethyl ketone; methyl ethyl ketone peroxide; dimethyl phthalate; potassium acetate; sodium acetate, sodium phenolate; sodium trichlorophenolate; potassium oleate; and p-dimethylaminomethylphenol; chlorotri-fluoroethylene (CFTE), ethylenetetrafluoroco-polymer (ETFE); tetrafluorethylene (TFE); and equivalents and combinations thereof. | 0.50% to 30.00% |
| III. Filler compounds include calcium oxide; calcium carbonate; cement; fly ash; fiberglass fibers; metal shavings; metal oxides; polyester fibers; aluminum oxides; mica; perlite; zeolites; vermiculite; silica; silicates; quartz sands, #12 sand; #30 sand, #60 sand; aggregate particles/granules of stone, rock, marble, gravel, glass, clay and talc; non-recyclable products (tire bits, plastic fibers and bits, wire strips, etc.), coloring agents; and equivalents and combinations thereof. | 5.00% to 80.0% |
| IV. Foam core system compounds include chemical constituents selected from the group consisting of 4,4'-diphenylmethane diisocyanate; tetramethylene diisocyanate; hexamethylene diisocyanate; m-xylylene diisocyanate; p-xylylene diisocyanate; hydroxyl terminated poly oxyalylene; 4,4'-dimethyl-1,3-xylylene diisocyanate; cyclohexane-1,4-diisocyanate; dicyclohexyl-methane-4,4'-diisocyanate; m-phenylene diisocyanate; p-phenylene diisocyanate; 1-alkylbenzene-2,4- and 1-benzylbenzene-2, 6-diisocyanate; 2,6-diethylbenzene-1,4-diiscoyanate; 3,3'-dimethoxydiphenylmethane-4,4'-diisocyanate; naphthylene-1,5-diisocyanate; polydroxypolyethers; poly-hydroxypolyesters; cellulosics; tenite; irradiated polyolefins; polymeric urethane resins; cardboard; and equivalents and combinations thereof. | 5.0% to 70.0% |
| V. Curing agents include dimethylbenzylamine; tertiary amines; trimethylene amine; permethylated diethylene triamine; N-methyl-N'-(N,N-dimethylaminoethyl)-piperazine; dibutyl tin dilaurate; tin-(II) octoate ucardel; styron; lustrex; dylene; rexolite; and combina-tions thereof. | 10 ppm to 3.00% |
| VI. Drying agents include cobalt 6% naphthenate; tris (chloroethyl)-orthoformate; calcium oxide; calcium chloride; phosphoric anhydride; alumina oxide; silica gels; kapton; pyralin; keramid; torlon; polyamide imides pentene-oxide polyphenylene; and equivalents and combinations thereof. | 10 ppm to 10.00% |
| NON-CHEMICAL ENTITY | |
| VII. Structural reinforcement support systems includes fiberglass rovings, fiberglass string, fiberglass rods, fiberglass fibers, fiberglass matting, steel/iron rebar, steel/iron rods, metal wiring, plastic rods, plastic strips, woven wire mesh, steel wool, metal cable, braided wiring, ceramic fibers, kevlar fibers and equivalents and combinations thereof. | 2.0% to 8.0% |

This first section will describe the chemical entities being the resin system, the catalytic agents, the fillers, the foam core system, the curing agents and the drying agents. The resin system of the composite material 10 of the present invention includes chemical constituents having chelating ion-exchange resins that have been synthesized in order to display unusually high selectivity for certain cations. The following types are represented:

1. Polystyrene matrix, containing imino-diacetate groups which are particularly selective for copper, nickel, cobalt, and iron;

2. Phenol-formaldehyde matrix, with 8-quinolinol replacing part or all of the phenol;
3. Phenol-formaldehyde matrix, with phenol replaced by m-phenylene diglycine or by o-aminophenol;
4. Polystyrene matrix impregnated with a solution of tributyl phosphate in perchloroethylene;
5. Polyacrylate matrix, cross-linked with a small percentage of divinylbenzene, in which carboxyl groups are converted to enolizable diketones;
6. Polymers containing bound porphyrin groups;
7. Polystyrene matrix, reduced and nitrated to produce a structure analogous to hexanitrodiphenylaminate which is selective for potassium in the presence of sodium;
8. Polyolefin matrix; and
9. Polyethylene matrix with other polymers and copolymers of ethylene.

These aforementioned resin matrixes can be strongly acidic, weakly acidic, strongly basic, intermediately basic or weakly basic, depending upon the type of resin matrix being used in the making of the composite material 10 of the present invention.

The resin system of the composite material 10 of the present invention is used for making castings having laminating and bonding characteristics to the resin in order to give to the product the mechanical properties of hardness; rigidness; being infusible and insoluble; and the product having extensive cross-linking. The resin system being used, is for providing a composite material having selected mechanical properties of hardness, rigidity, etc., as previously described above, and includes chemical constituents selected from the group consisting of polyesters, polyolefins, polystyrenes, polyvinyl chlorides, polyethylene and other polymers and copolymers of ethylene, acrylonitrilebutadiene-styrene copolymers, polyurethanes, polypropylenes, polycarbonates, polyamides, polyimides, polysulfones, polyaromatic oxides, nylons, styrene 1,2,4-trimethylbenzene; and equivalents and combinations thereof. The resin system of the composite material 10 has an overall range of 5.00% to 60.0% by weight of the composite material 10.

The catalytic agent for the composite material 10 of the present invention includes chemical constituents that are activated carbons, silica gels, activated alumina, activated clays, precious metals, alkaline or acid catalysts for resin reactions, and ionic- type catalysts which by their mere presence alters the velocity of a reaction, and the catalyst may be recovered unaltered in amount at the end of the reaction. The catalytic agent of the composite material 10 of the present invention is used for the polymerization of the resin system in the initiation of the reaction in which the reaction is allowed to proceed until no further chemical changes occur. The catalytic agent for catalyzing the aforementioned resin system, as previously described above, includes chemical catalytic agents selected from the group consisting of cobalt, sodium chloride, methyl ethyl ketone; methyl ethyl ketone peroxide; dimethyl phthalate; potassium acetate; sodium acetate, sodium phenolate; sodium trichloro-phenolate; potassium oleate; and p-dimethylaminomethylphenol; chlorotrifluoroethylene (CTFE), ethylenetetrafluorocopolymer (ETFE); tetrafluoroethylene (TFE); and equivalents and combinations thereof. The catalytic agent of the composite material 10 has an overall range of 0.50% to 30.0% by weight of the composite material composition.

The filler compounds 52 for the composite material 10 of the present invention include chemical constituents that are inactive chemical compounds which act as reinforcing agents that impart to a composition matrix considerable stiffness and rigidity, as compared with those of a pure resin. The filler compounds for the composite material 10 of the present invention are used for the addition of the filler compound(s) to the resin system to increase the modulus of elasticity and strength of the composite material 10. Additionally, this combination of resin system with filler compound 52 is used to produce a composite material 10 that is less brittle and more resistant to impact stresses, and at the same time maintaining adequate compressive, tensile, flexural and shear strengths 30, 31, 32 and 33, respectively, to the formed composite material 10. The filler compounds 52 for acting as a reinforcing agent, as previously described above, includes filler compounds selected from the group consisting of calcium oxide; calcium carbonate; cement; fly ash; fiberglass fibers; metal shavings; metal oxides; polyester fibers; aluminum oxides; mica; perlite; zeolites; vermiculite; silica; silicates; quartz sands, #12 sand; #30 sand, #60 sand; aggregate particles/granules of stone, rock, marble, gravel, glass, clay and talc; non-recyclable products (tire bits, plastic fibers and bits, wire strips, etc.), coloring agents; and equivalents and combinations thereof. The filler compound 52 of the composite material 10 has an overall range of 5.00% to 80.0% by weight of the composite material 10.

The foam core system 60 of the composite material 10 of the present invention includes chemical constituents having polymeric isocyanates, urethanes, styrenes and the like; as well as polyether polyol urethane resins in the form of polyhydroxyl compounds such as polyhydroxypolyethers or polyhydroxypolyesters. The foam core system compounds for the composite material 10 of the present invention are used for providing of a three-dimensional polymer having a high degree of cross-linking which results in product(s) having high and superior flexibility and at the same time, with the presence of three-dimensional cross-linking which accounts for toughness (compressive strength) and heat resistance of the cured product. The foam core system being used, for providing a composite material having selected mechanical properties of toughness and heat resistance as described above, includes chemical constituents selected from the group consisting of 4,4'-diphenylmethane diisocyanate; tetra-methylene diisocyanate; hexamethylene diisocyanate; m-xylylene diisocyanate; p-xylylene diisocyanate; 4,4'-dimethyl-1,3-xylylene diisocyanate; cyclohexane-1,4-diisocyanate; dicyclohexylmethane-4,4'-diisocyanate; m-phenylene diisocyanate; p-phenylene diisocyanate; 1-alkylbenzene-2,4- and 1-benzylbenzene-2,6-diisocyanate; 2,6 -diethylbenzene-1,4-dilsocyanate; 3,3'-dimethoxydiphenylmethane-4,4'-diisocyanate; naphthalene-1,5-diisocyanate; polydroxypolyethers; polyhydroxypolyesters; and equivalents and combinations thereof. The foam core system of the composite material 10 of the present invention has an overall range of 5.0% to 70.0% by weight of the composite material composition.

The curing agent for the composite material 10 of the present invention includes chemical constituents that are amine compounds, and organic tin compounds. The curing agent for the composite material 10 is used such that in the presence of heat $\Delta H$ the curing agent causes an extensive cross-linking of the aforementioned resin system, thereby forming a hard and rigid solid that is also infusible and insoluble. The curing agent for producing cross-linking within the resin system, as previously described above, includes curing agents selected from the group consisting of dimethylbenzylamine; tertiary amines; trimethylene amine; permethylated diethylene triamine; N-methyl-N'-(N,N-dimethylaminoethyl)-piperazine; dibutyl tin dilaurate; tin-(II) octoate; ucardel; styron; lustrex; dylene; rexolite; and combinations thereof. The curing agent of the composite material 10 has an overall range of 10 ppm to 3.0% by weight of the composite material composition.

The drying agent for the composite material 10 of the present invention includes chemical constituents that are driers, desiccators, exsiccator dehydrators and evaporators such that this hygroscopic substance(s) chemically binds and/or absorbs the moisture ($H_2O$) content within the composite material 10. Additionally, drying agents are dependent upon the chemical and physical action of adsorption and/or absorption for their overall efficiency. The drying agent of the composite material 10 is used for the drying and binding of any excess moisture (steam) in the process of producing the composite material 10. The drying agent for drying the moisture within the composite material 10, as previously described above, includes drying agents selected from the group consisting of cobalt 6% naphthenate; tris (chloroethyl)-orthoformate; calcium oxide; calcium chloride; phosphoric anhydride; alumina oxide; silica gels; kapton; pyralin; keramid; torlon; polyamide imides penteneoxide polyphenylene; and equivalents and combinations thereof. The drying agent of the composite material 10 has an overall range of 10 ppm to 10.0% by weight of the composite material.

This second section will describe the non-chemical entity being the structural reinforcement support system 70. The structural reinforcement support system 70 of the composite material 10 of the present invention includes internal structural supports for reinforcing the structural integrity of the composition matrix 40 of the composite material 10 (i.e. panels, power transmission poles, etc.). The structural reinforcement support system of the composite material 10 is used for integrally adding internal structural support to enhance compressive, tensile, flexural, and shear strengths 30, 31, 32 and 33, respectively, to the composition matrix 40 of the composite material 10. In this manner, a superior construction product is produced having structural standards that are better and higher than other building construction materials such as in steel or wood studded walls or as in concrete, cinder block or brick walls, as shown in Tables A and B and FIG. 12 of the drawings. The structural reinforcement support system for internally reinforcing the composition matrix 40, as previously described above, includes internal structural supports selected from the group consisting of steel/iron rebar 72, steel/iron rods 74, metal wiring, fiberglass rods, fiberglass roving 76, plastic rods and strips 78, woven wire mesh, steel wool, Kevlar™ fibers, metal cable, braided wiring, ceramic fibers and equivalents and combinations thereof. The structural reinforcement support system for internally reinforcing the composition matrix 40 of the composite material 10 has an overall range of 2.0% to 8.0% by weight of the composite material composition depending upon the type of internal structural support arrangement/configuration needed for the appropriate product being produced (i.e. panel, railroad tie, power transmission pole, etc.).

Additionally, the composite material 10 of the present invention includes locking systems 80 for joining one or more products together (panels, fencing sections, power transmission pole sections and the like). The locking system 80 for the composite material 10 is used for attaching several sections of panels, flooring, roofing, conduits, piping and the like by having within each panel male and female connection means for connection to adjacent male and female connecting means of that adjacent panel in order to form an exterior wall for a home or interior wall for a particular room, as shown in FIGS. 1, 2, 3, 5, 6, 7 and 9 of the drawings. The locking system 80 for joining together one or more panels, sections and the like, as previously described above, include locking such as cam locks 82; snap lock systems 83; slip fit lock systems; a track and ball lock system; a tension bolt and rod lock system; a hook bolt lock system; friction lock systems such as lap joints, lap splices, lap splice joints, ball joint attachments, dove tail joints, dowel joints, pin fitting joints, compression fitting joints, tenon and mortise, tongue and groove; and equivalents and combinations thereof.

Figure 4:
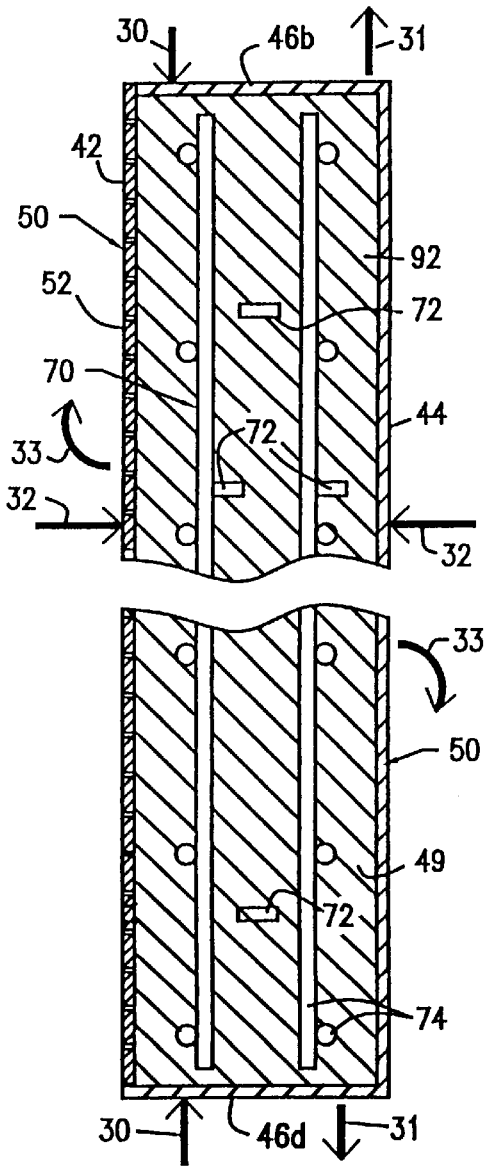
FIG. 4 is a cross-sectional view of the composite material for construction of the present invention taken along lines 4—4 of FIG. 1 showing the bonded and laminated composition matrix of the exterior wall panel having structural reinforcement supports therein.
Figure 5:
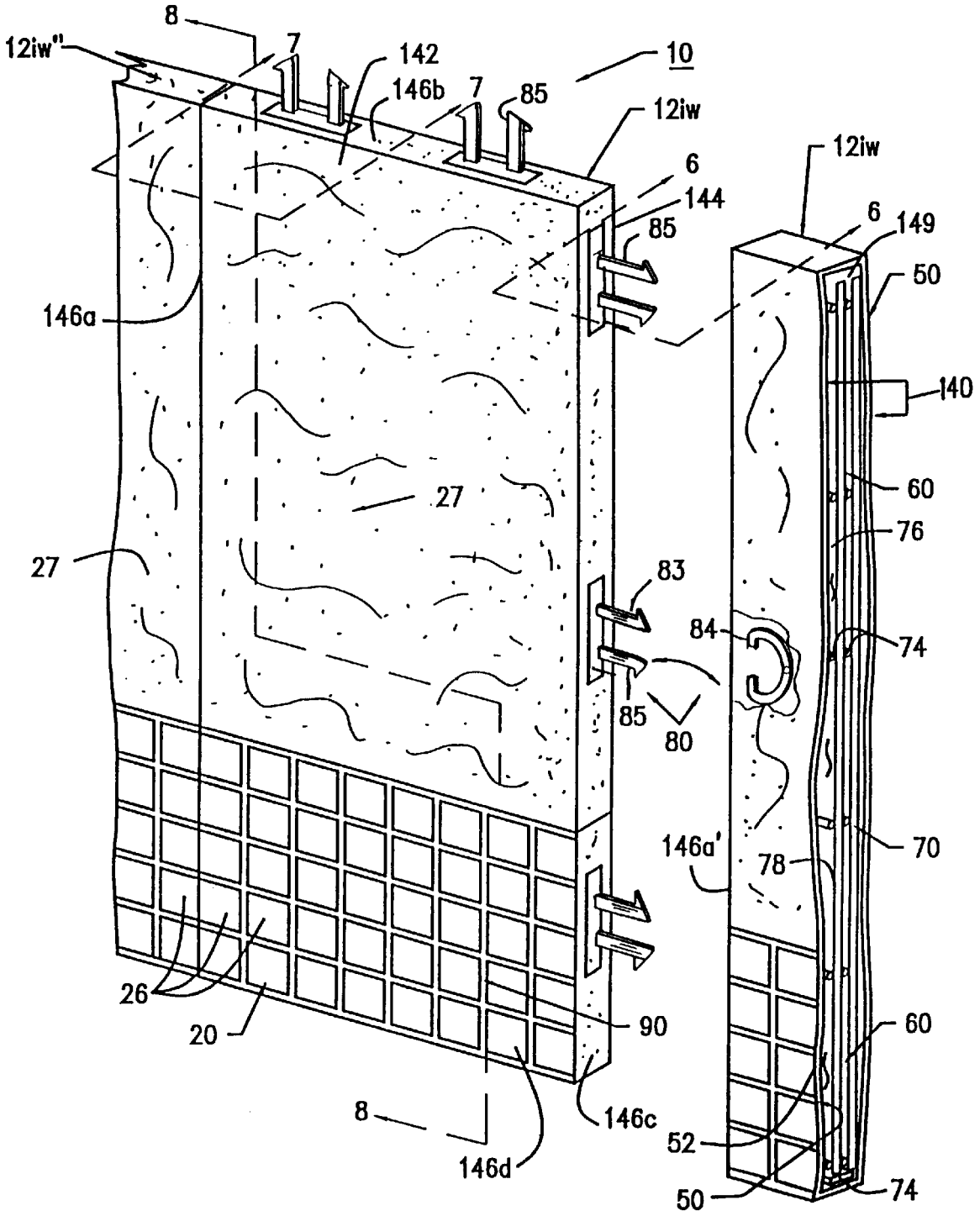
FIG. 5 is a perspective view of the composite material for construction of the present invention showing an interior wall erecting panel having an interior custom replicate surface of wall tile, and stucco; and a snap lock system for joining together to a second interior wall panel.
Figure 8:
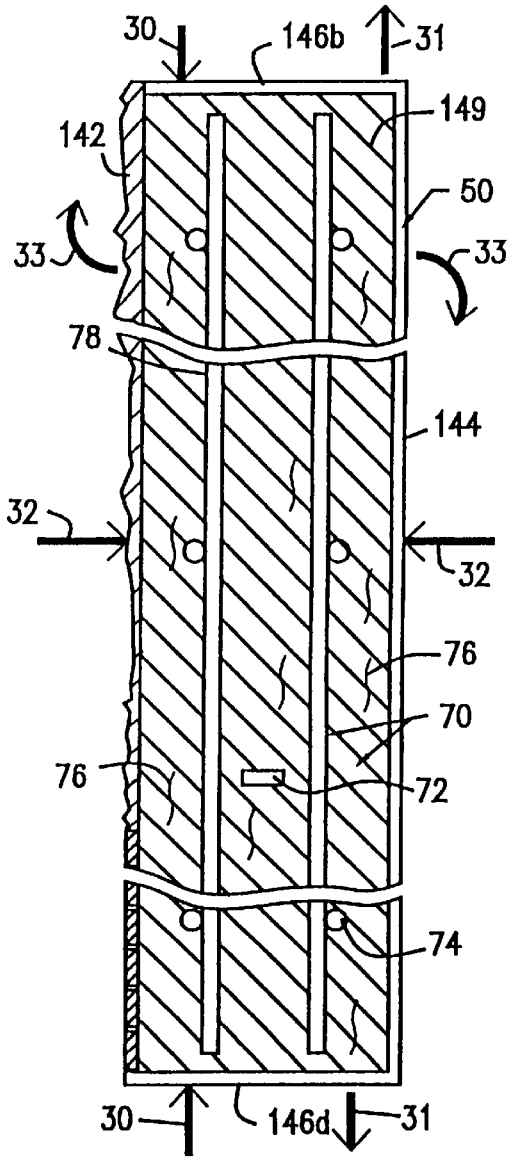
FIG. 8 is a cross-sectional view of the composite material for construction of the present invention taken along lines 8—8 of FIG. 5 showing the bonded and laminated composition matrix of the interior wall panel having internal spacers therein for wiring.
Figure 9:
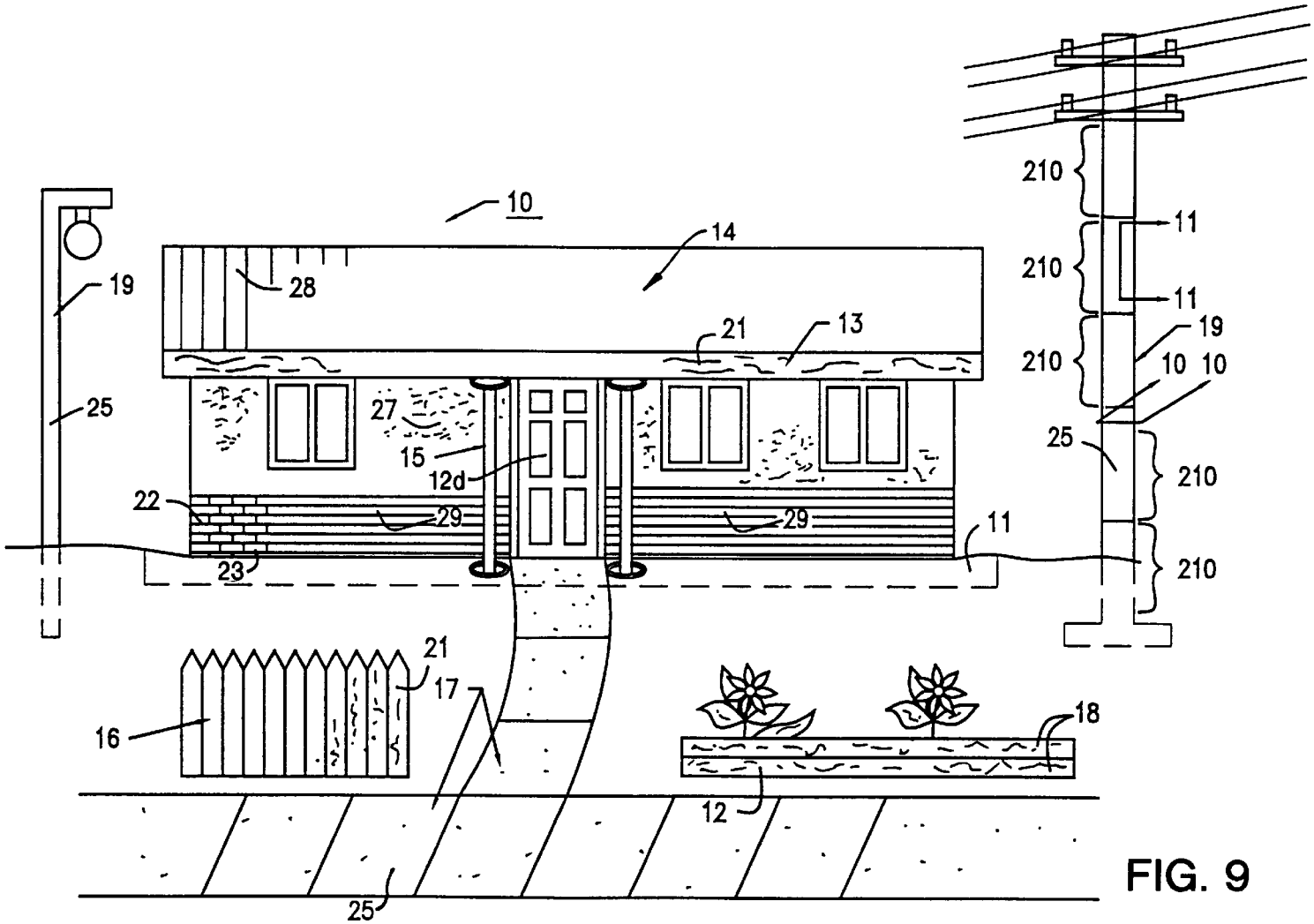
FIG. 9 is a front elevational view of the composite material for construction of the present invention showing products made from the composite material used in the building of a home having replicate surfaces including exterior walls of stucco and brick, a rough wood fascia, a tiled roof, a wood door, wood fencing, railroad ties for a garden, and a power transmission pole.

The composite material 10 for construction of the preferred embodiments 12*ew* and 12*iw* and the alternate embodiment 19 of the present invention are represented in detail by FIGS. 1 through 14 of the drawings. As shown in FIGS. 1, 5 and 9, composite material 10 can be used in making foundations/building pads 11, wall panels 12*ew*, doors 12*d*, facade facings 13, roofing panels 14, columns 15, fencing 16, sidewalks 17, railroad ties 18, power transmission poles/overhead lighting poles 19 and the like. In addition, the exterior wall surface 42 and/or interior wall surface 44 of exterior or interior wall panels 12*ew* and 12*iw*, doors 12*d*, facade facings 13, roofing panels 14, poles 19, etc., as shown in FIGS. 1, 5 and 9, can be made to have a custom surface 20 replicated in textures, colors, configurations and designs for making the aforementioned construction products having a replication look of wood 21, brick 22, cinder block/mortarless building blocks 23, stone/marble facings 24, cement 25, ceramic tile 26 (interior and exterior), stucco 27, roofing shingles 28, sidings 29, marble flooring and metal finishes. These aforementioned custom surfaces 20 are dependent upon the type of resin system 50 and filler compound 52 used within the composition matrix 40 of the composite material 10 composition being produced.

Figure 2:
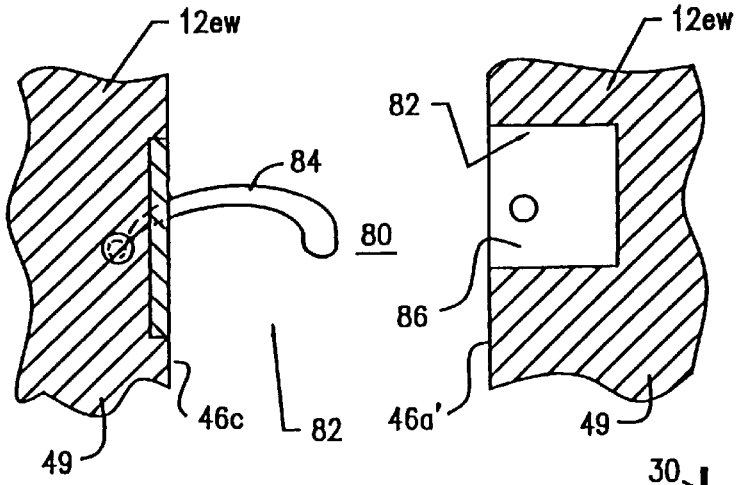
FIG. 2 is a cross-sectional view of the composite material for construction of the present invention taken along lines 2—2 of FIG. 1 showing the male hook member of the cam lock being readied for receiving of the female slot member of the cam lock system within the exterior wall panel.
Figure 3:
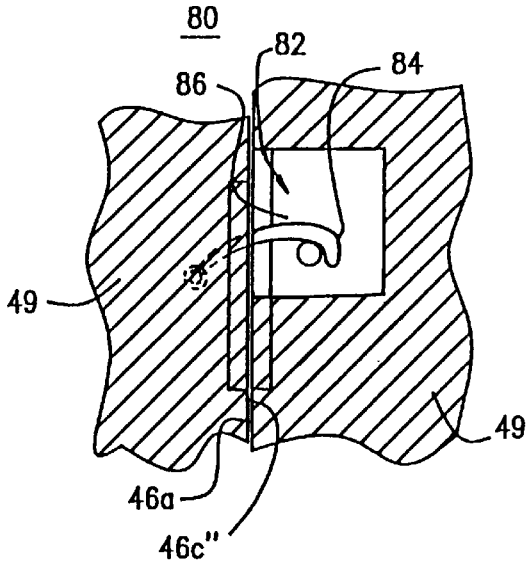
FIG. 3 is a cross-sectional view of the composite material for construction of the present invention taken along lines 3—3 of FIG. 1 showing the male hook member of the cam lock system being received within the female slot member of the cam lock system within the exterior wall panel.

As shown in FIGS. 1 and 9, the composite material 10 has been made into an exterior wall panel 12*ew* being used as a bearing wall. Wall panel 12*ew* includes a composition matrix 40 having an exterior wall surface 42, an interior wall surface 44, side wall surfaces 46*a*, 46*b*, 46*c* and 46*d*, and a center core section 49. The exterior wall surface 42 includes an exterior custom replicate surface 20 in the form of brick 22 and stone 24, as shown in FIG. 1. Side wall surfaces 46*c* and 46*d* include a plurality of openings 48 for receipt therein of cam lock system 82 for connecting with either the male or female connecting devices/members 84 or 86 of the cam lock system 82 in order to join one or more panels 12*ew* together, as shown in FIGS. 1 and 9 of the drawings. The composition matrix 40 has been molded to produce a bonded and laminated structure, as shown in FIG. 4 of the drawings, showing the exterior wall surface 42 being made from the resin system 50 and filler compound 52; the interior wall surface 44 being made from the resin system 50 only; the side wall surfaces 46*a* and 46*b* being made from the resin system 50 only; and the center core section 49 being made from the foam core system 60. The center core section 49 also includes the structural reinforcement support system 70 having therein structural supports in the form of steel rebar 72, steel rods 74, and fiberglass rovings 76, as shown in FIG. 4 of the drawings. As previously described, the locking systems 80 are also embedded within the center core section 49, adjacent to the side wall surfaces 46*a* to 46*d*, as shown in FIGS. 2 and 3 of the drawings.

Figure 6:
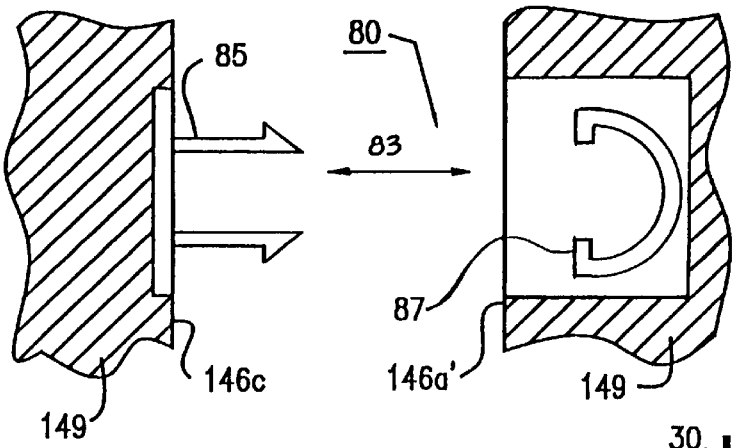
FIG. 6 is a cross-sectional view of the composite material for construction of the present invention taken along lines 6—6 of FIG. 5 showing the male slot member of the snap lock system being readied for receiving the female slot receiving member of the snap lock system within the interior wall panel.
Figure 7:
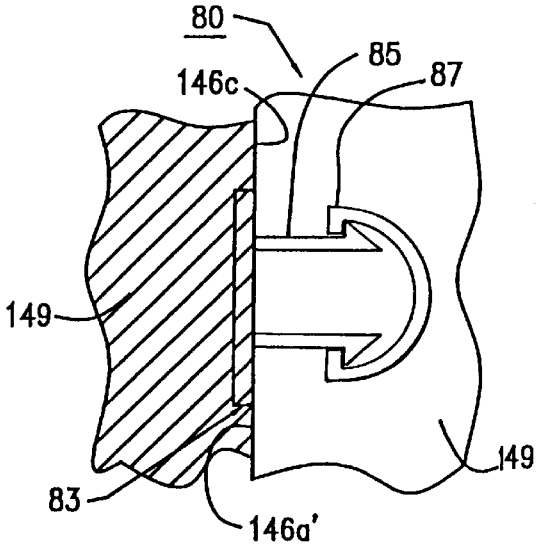
FIG. 7 is a cross-sectional view of the composite material for construction of the present invention taken along lines 7—7 of FIG. 5 showing the male slot member of the snap lock system within the interior wall panel being received within the female slot receiving member of the snap lock system within the interior wall panel.

As shown in FIG. 5, the composite material 10 has been made into an interior wall panel 12*iw* being used as a non-bearing wall. Wall panel 12*iw* includes a composition matrix 140 having an exterior wall surface 142, an interior wall surface 144, side wall surfaces 146*a*, 146*b*, 146*c* and 146*d*, and a center core section 149. The exterior wall surface 142 includes an exterior custom replicate surface 20 in the form of tile 26 and stucco 27 as shown in FIG. 5. Side wall surfaces 146*c* and 146*d* include a plurality of openings 148 for receipt therein of snap lock system 83 for connecting with either the male or female connecting members 85 or 87 of the snap lock system 83 in order to join one or more panels 12*iw* together, as shown in FIG. 5 of the drawings. The composition matrix 140 has been molded and cast to produce a bonded and laminated structure, as shown in FIG. 8 of the drawings, showing the exterior wall surface 142 being made from the resin system 50 and filler compound 52; the interior wall surface 144 being made from the resin system 50 only; the side wall surfaces 146*a* and 146*b* being made from the resin system 50 only; and the center core section 149 being made from the foam core system 60. The center core section 149 also includes the structural reinforcement support system 70 having therein structural supports in the form of steel rebar 72, steel rods 74, fiberglass rovings 76 and plastic rods 78, as shown in FIG. 8 of the drawings. As previously described, the locking systems 80 are also embedded within the center core section 149, adjacent to the side wall surfaces 146*a* to 146*d*, as shown in FIGS. 6 and 7 of the drawings.

Figure 10:
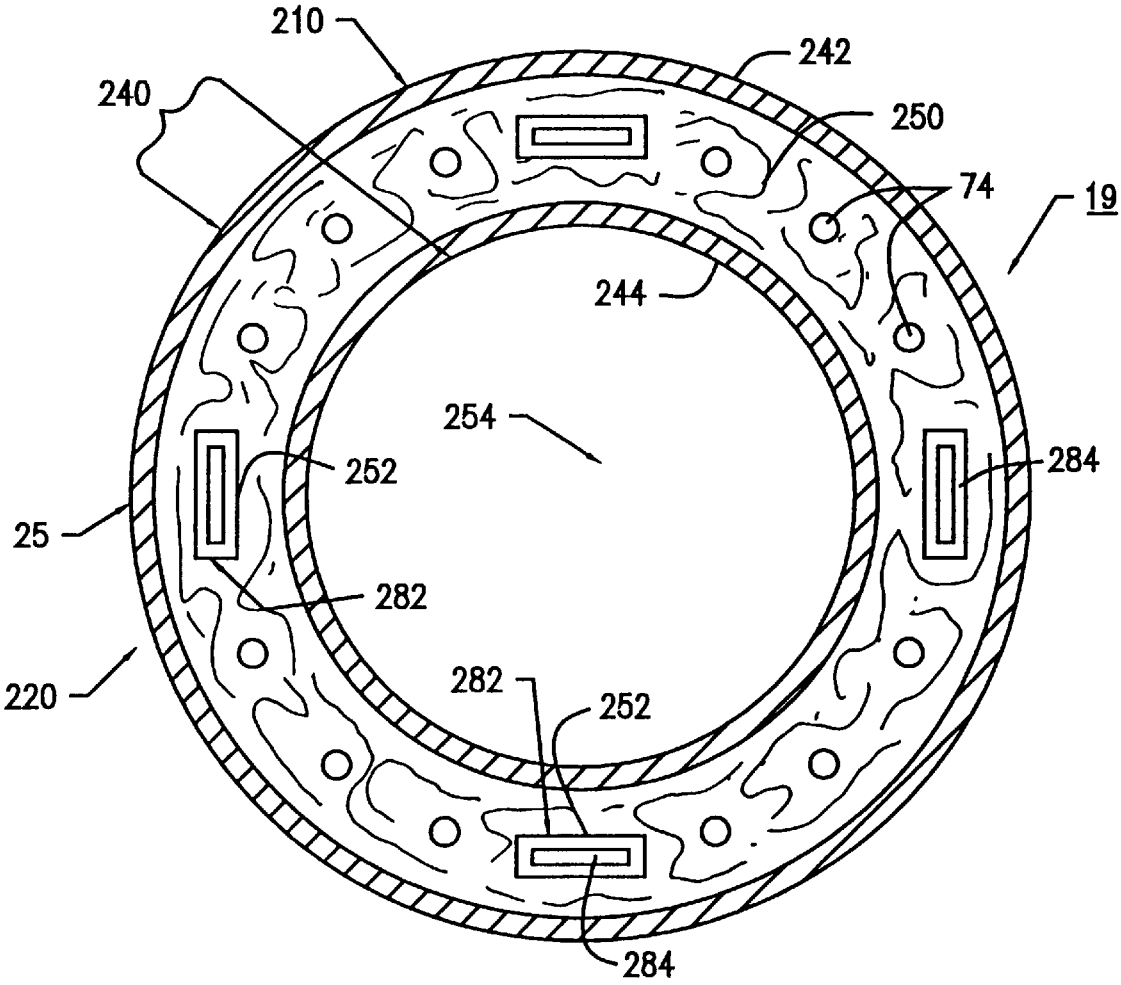
FIG. 10 is a cross-sectional view of the composite material for construction of an alternate embodiment of the present invention taken along lines 10—10 of FIG. 9 showing the transmission power pole having structural reinforcement supports therein and the locking system means therein for joining together to another section of the transmission power pole.
Figure 11:
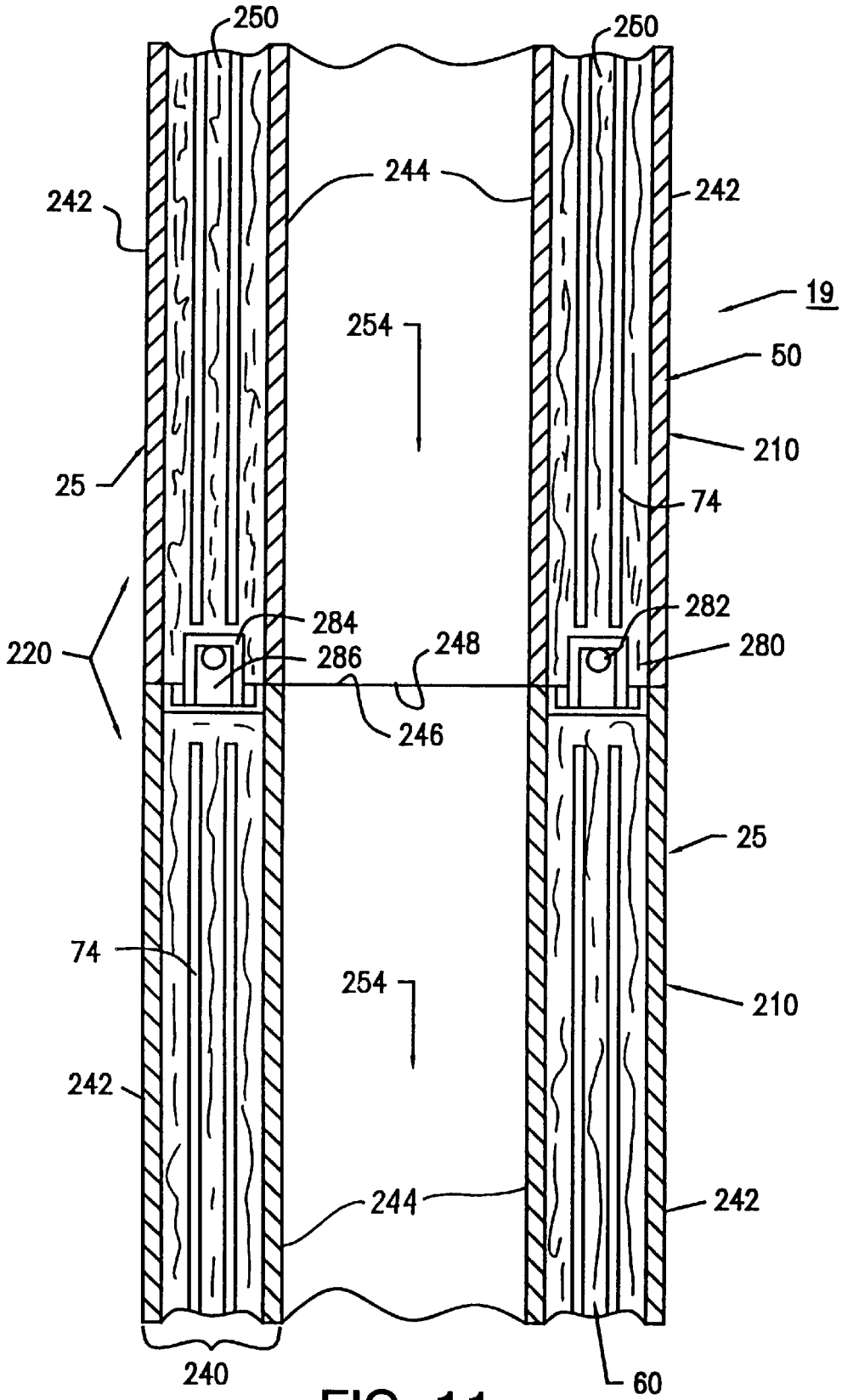
FIG. 11 is a cross-sectional view of the composite material for construction of an alternate embodiment of the present invention taken along lines 11—11 of FIG. 9 showing the transmission power pole having structural reinforcement supports therein and the locking system means therein for joining together to another section of the transmission power pole.

As shown in FIGS. 9, 10 and 11, the composite material 10 has been made into a power transmission pole 19 of an alternate embodiment being used to transfer electrical power. The power transmission pole 19 includes a plurality of interlocking pole sections 210 for forming the erected power transmission pole 19, as depicted in FIG. 9 of the drawings. Pole section 210 includes a composition matrix 240 having a circular exterior wall surface 242, a circular interior wall surface 244, circular side wall surfaces 246 and 248, an interior circular center core section 250 between wall surfaces 242 and 244, respectively, and having an interior hollow cavity 254 formed therein, as depicted in FIGS. 10 and 11 of the drawings. The circular exterior wall surface 242 includes an exterior custom replicate surface 220 in the form of cement 25, as shown in FIG. 9 of the drawings. Circular side wall surfaces 246 and 248 include a plurality of openings 252 for receipt therein of snap locking systems 282 for connecting with either the male or female connecting members 284 and 286 of the snap locking system 282 in order to join one or more sections 210 together, as shown in FIG. 9 of the drawings. The composition matrix 240 has been molded and cast to produce a bonded and laminated structure, as depicted in FIGS. 10 and 11 of the drawings, showing the circular exterior wall surface 242 being made from the resin system 50 and filler compound 52; the circular interior wall surface 244 being made from the resin system 50 only; the circular side wall surfaces 246 and 248 being made from the resin system 50 only; and the interior center core section 250 being made from the foam core system 60. The center core section 250 of the structural reinforcement support system 70 having therein structural supports in the form of steel rods 74 or spiral steel rods (not shown), as shown in FIGS. 10 and 11 of the drawings. As previously described, the locking systems 280 are also embedded within the center core section 250, adjacent to the circular side wall surfaces 246 and 248, as depicted in FIGS. 10 and 11 of the drawings.

Figure 13A:
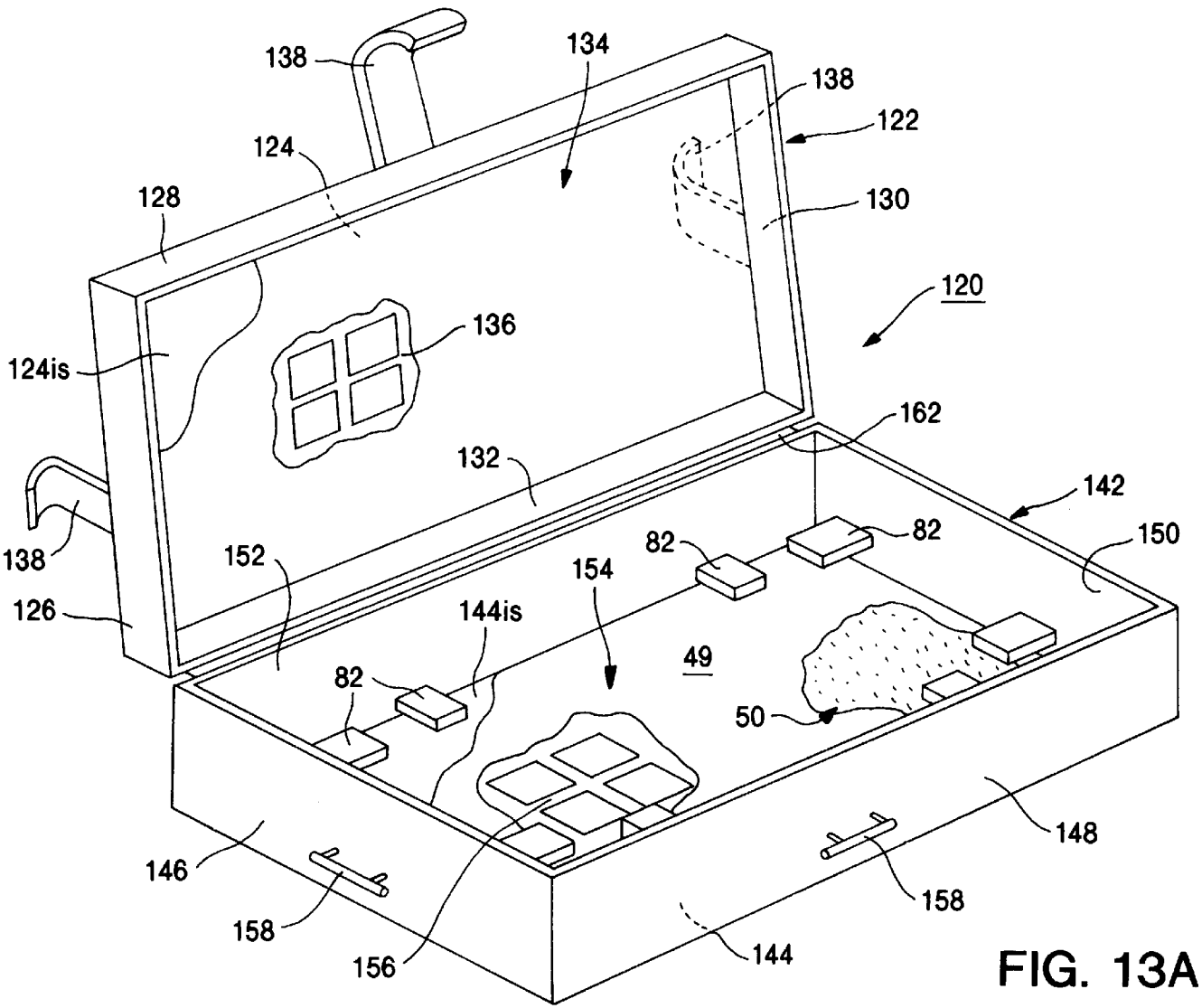
FIG. 13A is a perspective view of the composite material for construction of the present invention showing the mold tool for making of the exterior wall panel of FIG. 1 in the placement of the cam locks within the resin system.
Figure 13B:
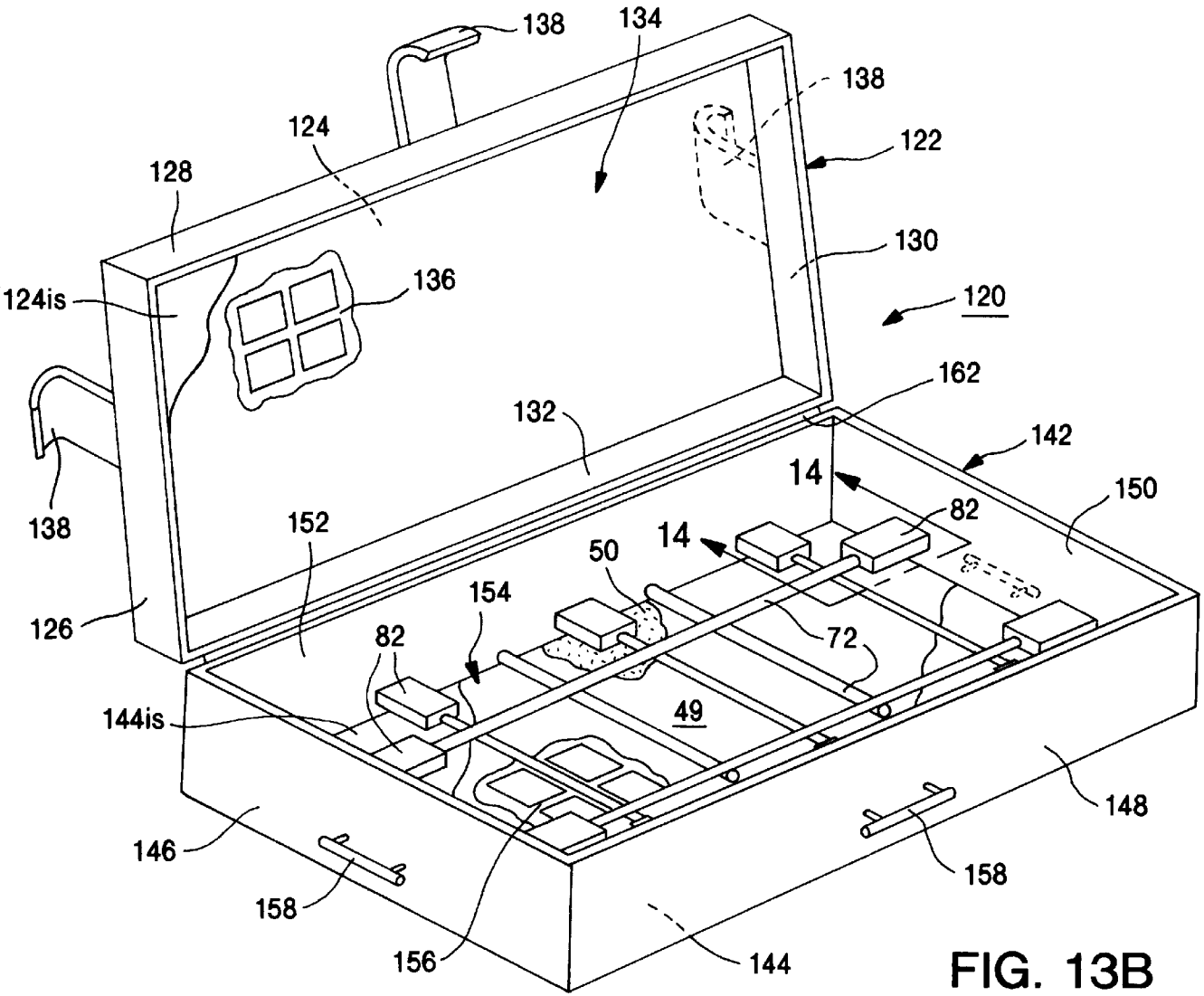
FIG. 13B is a perspective view of the composite material for construction of the present invention showing the mold tool for making of the exterior wall panel of FIG. 1 in the placement of the cam locks and structural supports within the resin system and foam system.
Figure 14:
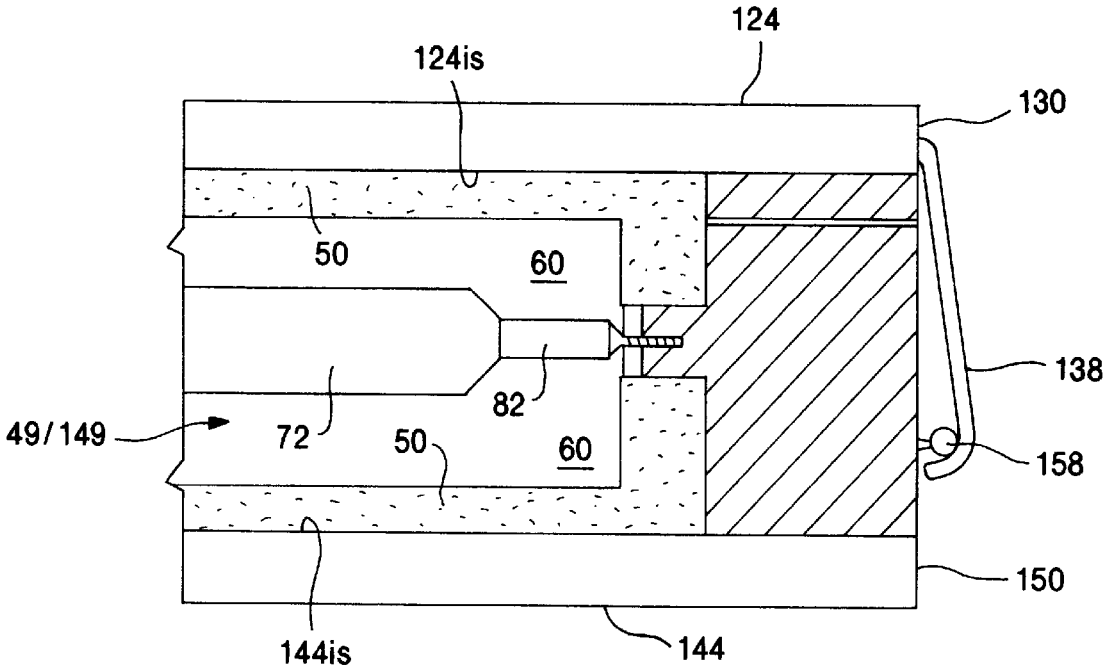
FIG. 14 is a cross-sectional view of the composite material for construction of the present invention taken along lines 14—14 of FIG. 13B showing the mold tool for making of the exterior wall panel of FIG. 1 in the placement of the cam locks and the structural reinforcement supports.

As shown in FIGS. 13A, 13B and 14 of the drawings, the molding tool 120 is depicted for making the exterior wall panel 12*ew* of FIG. 1, in which the placement of the cam locks 82 and the steel rebar and steel rods 72 and 74, respectively, of the structural reinforcement support system 70 are done within the center core section 49 of composition matrix 40. Molding tool 120 includes a first mold section 122 being substantially rectangular in shape and a second mold section 142 being substantially rectangular in shape. First and second mold sections 122 and 142 are hingedly connected together by hinge member 162 for opening and closing the first and second mold sections 122 and 142 together.

First mold section 122 includes a top wall member 124 and integrally attached side wall members 126, 128, 130 and 132 for forming an interior cavity 134. Top wall member 124 is used for making an outer exterior wall surface 42 of panel 12*ew* and includes an inner molding member 136 for making a particular type of a replicated custom surface 20, such as brick 22 and stone 24, as shown in FIG. 1 of the drawings. Inner molding member 136 is attached to the inner wall surface 124*is* of the top wall member 124 for making the replicated custom surface 20. Side wall members 126, 128 and 130 include a first attachment means 138 for sealing to a closed position the first and second mold sections 122 and 142 with each other, respectively. First attachment means 138 are in the form of male prongs of an attachment clamp assembly.

Second mold section 142 includes a bottom wall member 144 and integrally attached side wall members 146, 148, 150 and 152 for forming an interior cavity 154. Bottom wall member 144 is used for making an inner interior wall surface 44 of panel 12*ew* and includes an inner molding member 156 for also making a particular type of a replciated custom surface 20, such as tile 26 and stucco 27 finishes. Inner molding member 156 is attached to the inner wall surface 144*is* of the bottom wall member 144 for making the replicated custom surface 20. It should be noted that neither inner molding members 136 or 156 may necessarily be used in making a custom surface 20 for the exterior panel 12*ew*, as both surfaces 42 and 44 may be a smooth finish having no replicated custom surface 20 being integrally attached. Side wall members 146, 148 and 150 include a second attachment means 158 for sealing to a closed position the first and second mold sections 122 and 142 with each other, respectively. Second attachment means 158 are in the form of female receiving members of an attachment clamp assembly. It should be understood that different designs and configurations of mold tools are used in making the various types of the composite material 10 products such as poles, sewage piping, building foundations, docks, railroad ties and the like.

EXAMPLES OF THE PRESENT INVENTION

The aforementioned process for molding of various molded construction products is set forth in the molding of exterior and interior panels 12*ew* and 12*iw* having specific chemical compositions.

I. An exterior panel 12*ew* may be formed from the following composition of chemical materials:

Example 1

| | |
|---|---|
| Polyethylene | 30.0% By Weight |
| Calcium carbonate | 50.0% By Weight |
| Polyhydroxypolyester | 18.0% By Weight |
| Dylene | 1.5% By Weight |

-continued

| | |
|---|---|
| Cobalt 6% napthenate | 0.5% By Weight |
| Methyl ethyl ketone peroxide | 2.0% by weight in addition to the above |

II. An interior panel 12*iw* may be formed from the following composition of chemical materials:

Example 2

| | |
|---|---|
| Polystyrene | 47.0% By Weight |
| Fiberglass fibers | 5.0% By Weight |
| 4,4'- diphenylmethane diisocyanate | 37.0% By Weight |
| Permethylated diethylene triamine | 2.0% By Weight |
| Polyamide imides penteneoxide polyphenylene | 9.0% By Weight |
| Potassium acetate | 15.0% by weight in addition to the above |

III. An interior panel 12*iw* may be formed from the following composition of chemical materials:

Example 3

| | |
|---|---|
| Polycarbonate | 41.500% By Weight |
| Calcium carbonate | 50.000% By Weight |
| 3,3'- dimethoxydiphenylmethane-4,4' diisocyanate | 8.125% By Weight |
| Dylene | 0.250% By Weight |
| Cobalt 6% napthenate | 0.125% By Weight |
| Methyl ethyl ketone peroxide | 1.5% by weight in addition to the above |

OPERATION OF THE PRESENT INVENTION

The composite material 10 for construction can be made into panels 12*ew* and 12*iw*, as shown in FIGS. 1 and 5 of the drawings. These panels 12*ew* and 12*iw* are formulated and fabricated to fit any type of building project requirement. For example, the composite material 10 of the present invention that is made into panels 12*ew* can have a diversity of use, wherein the panels 12*ew* can be used for a hospital in the Antarctic or for a home in the Philippines. In both projects the panels 12*ew* have the same basic composition matrix 40 with just slight component variations to the overall composition of the composite material 12*ew*, such that each of the aforementioned panels 12*ew* or 12*iw* are at opposite ends of that panel's standard structural requirements. Material specifications for the composition of the composite material 10 are set forth in Table B, as follows:

TABLE B

COMPOSITE MATERIAL SPECIFICATIONS FOR THE PRESENT INVENTION

| ITEM | STANDARDS | MAX RESULT |
|---|---|---|
| Compressive Strength | ASTM D-1621 | 22,000 PSI |
| Flexural Strength | ASTM D-790 | 200,400 PSI |
| Tensile Strength | ASTM D-638 | 132,000 PSI |
| Shear Strength | ASTM C-273 | 15,000 PSI |
| Compressive Modulus | ASTM D-1621 & 256 | 16,002 PSI |
| Tensile Modulus | ASTM D-638 | 9,215,400 PSI |
| Flexural Modulus | ASTM D-790 | 8,282,400 PSI |
| Water Absorption | ASTM D-2842 | .079 # SF MAXIMUM |
| Moisture Vapor Transmission | ASTM C-355-64 & ASTM E-96 | 1.4 PERM. INCHES |
| Dimensional Stability | ASTM D-2126 | <1% |
| Tensile Elongation | ASTM D-638 | 2.5 |
| Service Temperature | N/A | −100 to +210 DEG. F. |
| Flame Spread* | ASTM E-84 | 0 |
| Smoke* | ASTM E-84 | 0 |
| Toxicity | ASTM E-84 | 0 |
| Weight | ASTM D-1622 | 126 PCF |
| R Factor | ASTM C-518 | 68 |
| Density - Filled | Gms/CC | 2.03 |
| Closed Cell Content | ASTM D-2856 | 1 |
| Viscosity | CPS @ 77 F | 400 to 500 |
| Gel to Peak Exothermic | Minutes | 7 to 11 |
| Peak Exothermic Temp. | ASTM D-2566/88 | 380–430 DEG. F. |
| UV Characteristics | | NEGLIGIBLE |

*These numerical ratings, as determined by ASTM test method E-84, are not intended to reflect hazards presented by these or any other material under actual fire conditions.

Table C is a comparative chart demonstrating the structural standards of the composite material 10 of the present invention in the form of an exterior wall (panel) 12*ew* versus other building construction materials such as a steel studded wall, a wood studded wall, a concrete wall, a cinder block wall and a brick wall. These comparative structural standards a shown in Table C are as follows:

TABLE C

COMPARISON OF STRUCTURAL STANDARDS FOR VARIOUS BUILDING CONSTRUCTION MATERIALS

| CONSTRUCTION MATERIAL | COMPRESSIVE STRENGTH PSI | TENSILE STRENGTH PSI | FLEXURAL STRENGTH PSI | SHEAR STRENGTH PSI | COMPRESSIVE STRENGTH TO WEIGHT RATIO CSW | WIND RATING MPH | R FACTOR | TOTAL WEIGHT POUNDS | FIRE RATING |
|---|---|---|---|---|---|---|---|---|---|
| Composite wall of the present invention size: 3' × 7' × 3.5" | 6,395,400 | 4,688,899 | 8,721,000 | 319,770 | 95,000 | 120 | 28 | 67 | 100% |
| Wood Studded Wall size: 3' × 7' × 3.5" | 3,024,000 | 3,628,800 | 3,628,800 | 302,400 | 9,600 | 80 | 12 | 315 | 1 HR |

TABLE C-continued

COMPARISON OF STRUCTURAL STANDARDS FOR VARIOUS BUILDING CONSTRUCTION MATERIALS

| CONSTRUCTION MATERIAL | COMPRESSIVE STRENGTH PSI | TENSILE STRENGTH PSI | FLEXURAL STRENGTH PSI | SHEAR STRENGTH PSI | COMPRESSIVE STRENGTH TO WEIGHT RATIO CSW | WIND RATING MPH | R FACTOR | TOTAL WEIGHT POUNDS | FIRE RATING |
|---|---|---|---|---|---|---|---|---|---|
| Steel Studded Wall size: 3' × 7' × 3.5" | 3,628,800 | 3,628,800 | 3,628,800 | 302,400 | 11,520 | 80 | 12 | 315 | 1 HR |
| Concrete Wall size: 3' × 7' × 3.5" | 6,402,000 | 2,419,200 | N/A | 226,800 | 3,314 | 120 | 1 | 1,932 | 100% |
| Block Wall size: 3' × 7' × 6" | 907,200 | 1,512,000 | N/A | 114,912 | 508 | 120 | 8 | 1,785 | 100% |
| Brick Wall size: 3' × 7' × 6" | 302,400 | 2,419,200 | N/A | 151,200 | 267 | 120 | 9 | 1,134 | 100% |

been unexpectedly generated in the end product(s) of the composite material 10 of the present invention, in the form of exterior wall panel 12*ew*. Those structural features are (1.) the compressive strength to weight ratio 34 (CSW Ratio 34) and (2.) the R Factor 35. This CSW Ratio 34 of 95,000 psi/pound and greater demonstrates the ability of the wall panel 12*ew* to have the capacity to sustain a heavy loading to the bearing wall. This CSW ratio of 95,000 psi/pound for wall panel 12*ew* demonstrates that it can withstand a strong (heavy) loading and have superior resistance to natural forces such as heavy wind from storms, hurricanes, tornadoes, cyclones and the like, snow, ice and earthquakes, etc. This CSW ratio 34 shows that the wall panel 12*ew* is 8× times (95,000÷11,520) stronger than the steel studded wall; ≅10× times (95,000÷96,000) stronger than the wood studded wall; and 27× times (95,000÷3,314) stronger than the concrete built wall.

This R Factor 35 having a value of 28 or greater demonstrates the resistance measurement of heat or cold transfer (thermal coefficients) through the wall space of wall panel 12*ew*. The R Factor 35, as shown from the composition matrix 40 having these high values is dependent upon the density of foam within the center core section 49 of composition matrix 40, wherein the density of the foam is 3.5 lbs per cu.ft. and higher. The national standard average for the R Factor for walls is a value of 11, with a typical insulation/foam density of about 2.0 lbs per cuft. The R Factor 35 for the composite material 10 of the present invention includes R Factor values in the overall range of 28 to 68 per hr-ft$^2$-° F./BTU of the composite material 10.

Figure 12:
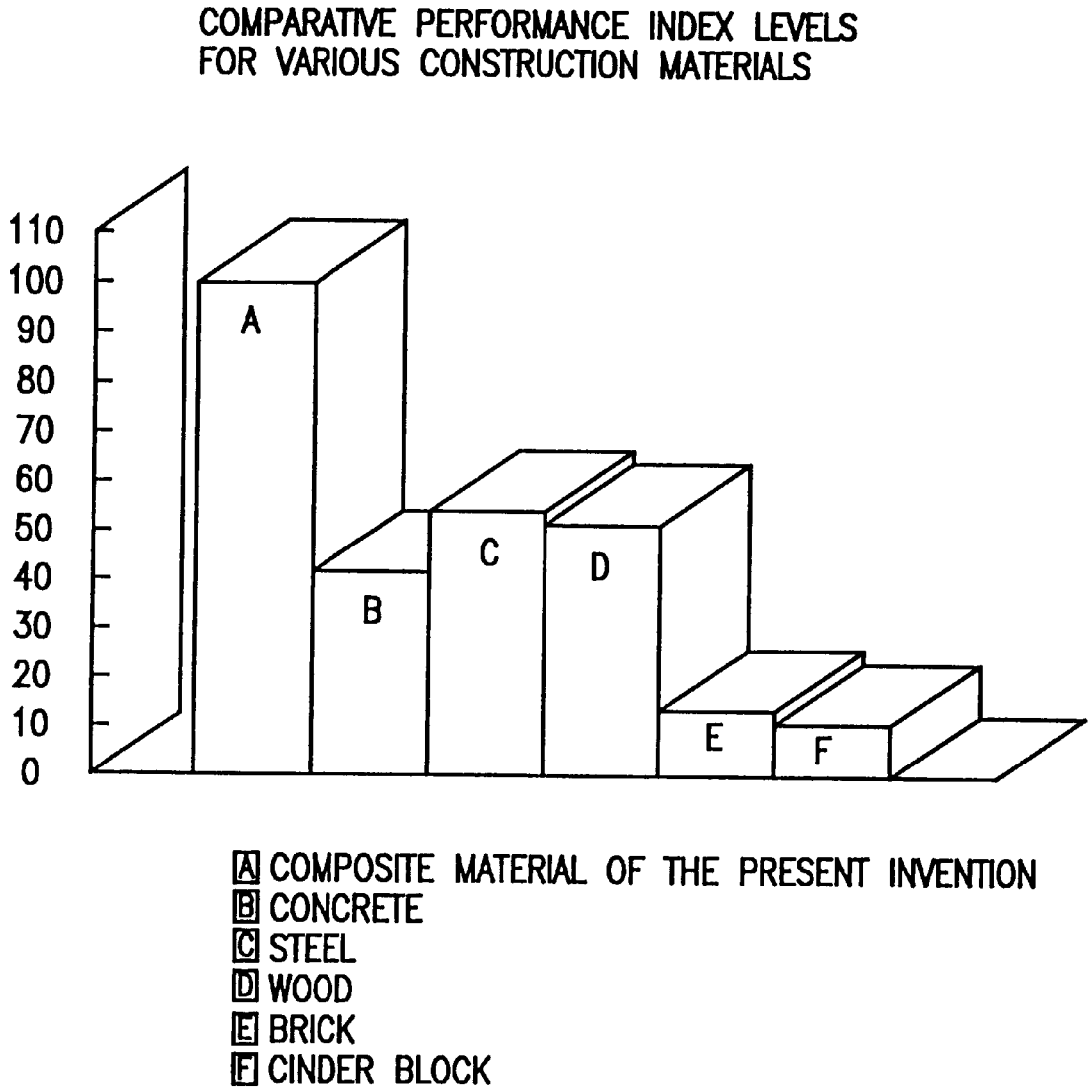
FIG. 12 is a graph of the composite material for construction of the present invention showing a comparative performance index of the composite material of the present invention versus concrete, steel, wood, brick and cinder block.

FIG. 12 depicts a graph showing comparative performance index levels for various construction materials that include the composite material 10 of the present invention and concrete, steel, wood, brick and cinder block. The comparative performance index level is based on Table C using the compressive, tensile, flexural and shear strengths of each cited material used (as previously mentioned); the strength to weight ratio (CSW ratio) of each construction material; and the overall material thickness of each construction material in comparison to the composite material 10 of the present invention.

As shown in Table D and FIG. 12, steel and wood materials have a performance index level of approximately 55; concrete material has a performance index level of 45; and brick and cinder block materials have a performance index level of approximately 12; being compared to a performance index level of 99 for the composite material 10 of the present invention. Based upon these comparative performance index levels, as shown in FIG. 12 of the drawings, the composite material 10 of the present invention has a performance level that is approximately 2× times higher than steel and wood materials, and approximately 9× times higher than brick and cinder block materials.

TABLE D

COMPARATIVE PERFORMANCE INDEX LEVELS FOR VARIOUS CONSTRUCTION MATERIALS

| CONSTRUCTION MATERIAL | WALL THICKNESS | PERFORMANCE LEVEL |
|---|---|---|
| Cinder Block | 6" | 10.95 |
| Brick | 6" | 12.0 |
| Concrete | 3.5" | 45.2 |
| Wood | 3.5" | 54.2 |
| Steel | 3.5" | 56.5 |
| Composite Material of the Present Invention | 3.5" | 99.0 |

In making the exterior wall panel 12*ew* having an exterior wall surface 42 with a replicated custom surface 20 and a smooth interior wall surface 44, the producer/molder uses a molding tool 120, as shown in FIGS. 13A, 13B and 14 of the drawings, for casting of panel 12*ew* using the composite material 10. The method 400 of cast molding an exterior wall panel 12*ew* in a molding tool 120, as shown in FIGS. 13A, 13B, 14, 15A, 15B and 15C includes the following steps of examining/inspecting/cleaning/preparing 410 the molding tool 120 for the molding process; spraying a releasing agent 420 within the mold cavities 134 and 154 of molding tool 120; applying and curing resin system 430 within the mold cavity 154 for a predetermined time period in the range of 2 to 3 minutes; inserting and placing the non-chemical entities 440 within the mold a cavity 154, such as the locking means 80 at predetermined locations during the curing of the resin system 50 and the reinforcement means 70 at predetermined locations after resin system 50 has cured; spraying resin system 50 with fiberglass 450 (optional) when applying reinforcing wire mesh to the mold cavity 154 for additional strength; pouring foam core system 460 into the mold cavity 154 of molding tool 120; closing and clamping the molding tool 470 and curing the foam core composition 60 for a predetermined time period in the range of 18 to 20 minutes; and opening and unclamping of molding tool 480 for removing the molded construction product from the molding tool 120. Processing steps 410, 420, 430, 440, 450, 460, 470 and 480 are all performed manually by the case molding operator.

To start the cast molding process 400, the molding operator initially begins with the examination and inspection of the first and second mold sections 122 and 142 of the molding tool 120 to check if molding tool 120 is in proper working order.

The molding tool 120 is then final cleaned with acetone to remove any leftover debris from the previous casting after an initial cleaning with acetone has been performed. To each of the mold sections 122 and 142 an appropriate inner molding form 136 and/or 156 is attached to the inner wall surface 124*is* and 144*is* of the interior mold cavity 134 and 154 for making a replicated custom surface 20, if desired.

The next step 420 has the molding operator spraying a releasing agent to each of the inner molding members 135 and/or 156 (if attached to mold sections 122 and/or 142). These mold members 136 and/or 156 are sprayed with a releasing agent such as Aqualift™, such that each of the sides 42, 44, 46*a* to 46*d* of panel 12*ew* are released from the molding tool 120 upon completion of the molding process.

In step 430 the molding operator applies the resin system 50 to the interior of mold cavities 134 and 154. The molding operator(s) simultaneously apply the resin system 50 which is a mixture of a resin compound, a catalyst, a filler compound 52 (for forming of the texture, color and configuration of the replicated custom surface 20), and reinforcing materials. The resin system 50 is hand applied, injected or sprayed into each of the interior mold cavities 134 and 154 up to a depth of 0.5 inches and allowed to cure for up to ½ to 18 minutes having a preferred curing range of 2 to 3 minutes. The resin system 50 is also applied to the side walls 126, 128, 130, 132, 146, 148, 150 and 152 to a thickness of 0.5 inches and allowed to cure for up to ½ to 18 minutes having a preferred curing range of 2 to 3 minutes.

In the following step 440 the molding operator is inserting and placing the non-chemical entities within the molding cavities 134 and 154 appropriately. In sub-step 442, the molding operator is preparing for placement of the locking systems 80. The locking systems 80 are in the form of cam locks 82, snap lock systems 83 and the like, and are placed at predetermined locations adjacent to the side walls of the lower interior mold cavity 154, such that these locking systems 80 are positioned within the center core section 49 and adjacent to the side walls of the second molding section 142 appropriately. These placements of locking systems 80 are done during the curing of the resin system 50 of Step 3. In sub-step 444, the molding operator is preparing for placement of the structural reinforcement support system 70. The structural reinforcement support system 70 is in the form of steel, iron or plastic rebar or rods, or fiberglass roving, strips etc. and are placed at predetermined locations within each of the interior mold cavities 134 and 154, such that these internal structural supports will be positioned within the center core section 49 of the composition matrix 40.

In the following Step 450 (optional), the panel 12*ew* may include for additional strength a reinforcing wire mesh which is applied to the mold cavity 154 by the mold operator. If so, an additional mixture of the resin system 50 with fiberglass is applied within the mold cavity 154 of the second mold section 142 in order to cover and hold the reinforcing wire mesh in place. This additional application of resin system 50 with fiberglass is allowed to cure for almost ½ to 18 minutes having a preferred curing range of 2 to 3 minutes.

In step 460, the molding operator prepares for the pouring of a foam core system 60 mixture. A liquid mixture is prepared by the operator of the foam core system 60 being 50% by weight of polymeric diphenylmethane 4,4 diisocyanate and 50% by weight of polymeric polyurethane resin. This mixture is then poured into one corner area and inner sides within the interior mold cavity 154 of the second mold section 142.

In the following step 470, the molding operator is manually closing and clamping the molding tool 120, such that the first mold section 122 is closed and clamped shut to the second mold section 142 of molding tool 120. The foam core system 60 chemical components within the composition matrix 40 are allowed to expand and cure for ½ to 30 minutes having a preferred curing range of 18 to 20 minutes.

In the last step 480, the molding operator is manually opening and unclamping the molding tool 120, such that the first mold section 122 is unclamped and opened from the second mold section 142, wherein the finished casted exterior wall panel 12*ew* is then removed from the interior mold cavity 154 of the second mold section 142, thus completing the molding of wall panel 12*ew*.

ADVANTAGES OF THE PRESENT INVENTION

Accordingly, an advantage of the present invention is that it provides for a composite material for construction used in the building and construction of personal dwellings/houses, commercial business, and industrial facilities, wherein such construction composite products include foundations, building pads, interior wall erecting panels, exterior wall panels, facade facings, roofing panels, mortarless building blocks, conduits, columns, sewage piping, manholes, manhole covers, septic tanks, insulation barriers, fire rated acoustical panels and the like.

Another advantage of the present invention is that it provides for a composite material for construction used in the manufacture of power transmission poles, utility poles, overhead lighting poles; sewage facility infrastructure piping and septic tanks; railroad ties; pallets; spacers; insulation barriers for protecting hulls, bulkheads, overheads, and compartments of ships, aircraft, railway tanker cars, tanker trucks, military vehicles (i.e. tanks) and the like; piers and docks; pylons; dolphins; buoys; and chemical storage tanks.

Another advantage of the present invention is that it provides for a composite material for construction used in the building construction of site accessories such as streets, walkways, fencing, outdoor benches and tables, playground equipment (swings, jungle gyms, seesaws and the like); and overhead lighting poles.

Another advantage of the present invention is that it provides for a composite material for construction that is a bonded composition matrix which includes a unique combination of chemical components having integral support structures (non-chemical) therein for an improved method of manufacture of panels, transmission poles, conduits, piping, insulation barriers and the like.

Another advantage of the present invention is that it provides for a composite material for construction that gives excellent production of custom surfaces, textures and colors in replicating such construction products as wood, brick, cinder block, stone, cement, metal finishes ceramic tile, stucco, roofing shingles, siding, marble flooring and the like.

Another advantage of the present invention is that it provides for a composite material for construction that has a performance index level superior to that of construction materials such as concrete, steel, wood, brick and cinder block for compressive, tensile, flexural and shear strengths.

Another advantage of the present invention is that it provides for a composite material for construction that has a compressive strength to weight ratio greater than 95,000 and a R factor greater than 25 (R factor is the measure of the thermal resistance of the material for the passage of heat therethrough hr-ft$^2$-° F./BTU).

Another advantage of the present invention is that it provides for a composite material for construction that reduces product manufacturing costs due to more efficient process production methods.

Another advantage of the present invention is that it provides a composite material for construction that will increase product distribution efficiency due to increased trucking capacity in carrying lighter weight components.

Another advantage of the present invention is that it provides for a composite material for construction that reduces product weight to below 130 pounds per cubic foot due to new and improved manufacturing methods in order to decrease product shipping costs due to lighter weight components.

Another advantage of the present invention is that it provides for a composite material for construction that will increase cash flow due to increased production rates in the manufacturing of the composite material products in using the new and improved manufacturing methods of the present invention.

Another advantage of the present invention is that it provides for a composite material for construction that will increase profits through the use of more cost effective products made from thee composite material of the present invention.

A still further advantage of the present invention is that it provides for a composite material for construction that can be mass produced in an automated and economical manner and is readily affordable by the construction user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A molded construction product having one or more walls and an inner core section, comprising:

a) a composition matrix including a resin system, a catalytic agent and filler compounds for forming said walls; a foam core system for forming said inner core section; a curing agent and a drying agent;

b) said resin system for providing mechanical and physical characteristics of hardness and rigidity to said walls of said molded product, said resin system having a range of 5.00% to 60.0% by weight of said composition;

c) said filler compounds for reinforcing said walls, said filler compounds having a range of 5.0% to 80.0% by weight of said composition;

d) said catalytic agent for activating the reaction for the polymerization of said resin system, said catalytic agent having a range of 0.50% to 30.00% by weight of said composition;

e) said foam core system for producing said inner core section having three-dimensional cross-linking and a core density of 3.5 pounds per cubic foot, said foam core system having a range of 5.0% to 70.0% by weight of said composite material composition;

f) said curing agent for cross-linking of polymers within said resin system for forming said walls to be hard, rigid, and infusible, said curing agent has a range of 10 ppm to 3.00% by weight of said composition;

g) said drying agent for drying and binding of excessive moisture within said composite material composition; said drying agent having a range of 10 ppm to 10.00% by weight of said composition;

h) a structural reinforcement support system for reinforcing the structural integrity of said composition matrix of said composite material composition; and i) a locking system for joining together one or more of said molded products.

2. A molded construction product in accordance with claim 1, wherein said resin system includes chemical compounds selected from the group consisting of polyesters, polyolefins, polystyrenes, polyvinyl chlorides, polyethylenes and other polymers and copolymers of ethylene, acrylonitrilebutadiene-styrene copolymers, polyurethanes, polypropylenes, polycarbonates, polyamides, polyimides, polysulfones, polyaromatic oxides, nylons, and styrene 1,2, 4-trimethlybenzene.

3. A molded construction product in accordance with claim 1, wherein said catalytic agent includes chemical compounds selected from the group consisting of cobalt, sodium chloride, methyl ethyl ketone, methyl ethyl ketone peroxide, dimethyl phthalate, potassium acetate, sodium acetate, sodium phenolate, sodium trichloro-phenolate, potassium oleate, p-dimethylaminomethylphenol, chlorotrifluoroethylene (CTFE), ethylenetetrafluorocopolymer (ETFE), and tetrafluoroethylene (TFE).

4. A molded construction product in accordance with claim 1, wherein said filler compounds are selected from the group consisting of calcium oxide, calcium carbonate, fly ash, fiberglass fibers, quartz sand, coloring agents and combinations thereof.

5. A molded construction product in accordance with claim 4, wherein said filler compounds are selected from the group consisting of cement; metal shavings; metal oxides; polyester fibers; aluminum oxides; mica; perlite; zeolites; vermiculite; silica; silicates; #12 sand; #30 sand, #60 sand; aggregate particles or granules of stone, rock, marble, gravel, glass, clay, and talc; non-recyclable products including tire bits, plastic fibers and bits and wire strips; and combinations thereof.

6. A molded construction product in accordance with claim 4, wherein said filler compounds in conjunction with said resin system form a replicate custom surface for one or more of said walls.

7. A molded construction product in accordance with claim 6, wherein said replicate custom surface is selected from the group consisting of wood, brick, cinder block, stone, cement, metal finishes, ceramic tile, stucco, roof shingles, siding and marble flooring.

8. A molded construction product in accordance with claim 1, wherein said foam core system includes chemical compounds selected from the group consisting of 4,4'-diphenylmethane diisocyanate; tetramethylene diisocyanate; hexamethylene diisocyanate; m-xylylene diisocyanate; p-xylylene diisocyanate; hydroxyl terminated poly oxyalylene; 4,4'-dimethyl-1,3-xylylene diisocyanate; cyclohexane-1,4-diisocyanate; dicyclohexyl-methane-4,4'-diisocyanate; m-phenylene diisocyanate; p-phenylene diisocyanate; 1-alkylbenzene-2,4- and 1-benzylbenzene-2,6-diisocyanate; 2,6-diethylbenzene-1,4-diisocyanate; 3,3'-dimethoxydiphenylmethane-4,4'-diisocyanate; naphthylene-1,5-diisocyanate; polyhydroxypolyethers; polyhydroxypolyesters; cellulosics; tenite; irradiated polyolefins; polymeric urethane resins; and combinations thereof.

9. A molded construction product in accordance with claim 1, wherein said curing agent is selected from the group consisting of dimethylbenzylamine; tertiary amines; trimethylene amine; permethylated diethylene triamine; N-methyl-N'-(N,N-dimethylaminoethyl)-piperazine; dibutyltin dilaurate; tin-(II) octoate ucardel; styron; lustrex; dylene; rexolite; and combinations thereof.

10. A molded in construction product in accordance with claim 1, wherein said drying agent is selected from the group consisting of cobalt 6% naphthenate; tris(chloroethyl)-orthoformate; calcium oxide; calcium chloride; phosphoric anhydride; alumina oxide; silica gels; kapton; pyralin; keramid; torlon; polyamide imides penteneoxide polyphenylene; and combinations thereof.

11. A molded construction product in accordance with claim 1, wherein said structural reinforcement support system includes structural components selected from the group consisting of fiberglass rovings, fiberglass string, fiberglass rods, fiberglass fibers, fiberglass matting, steel and iron rebar, steel and iron rods, metal wiring, plastic rods, plastic strips, woven wire mesh, steel wool, metal cable, braided wiring, ceramic fibers, and combinations thereof.

12. A molded construction product in accordance with claim 1, wherein said locking system includes locking mechanisms selected from the group consisting of cam lock systems; snap lock systems; slip fit lock systems; a track and ball lock system; a tension bolt and rod lock system; a hook bolt lock system; friction lock systems including lap joints, lap splices, lap splice joints, ball joint attachments, dove tail joints, dowel joints, pin fitting joints, compression fitting joints, tenon and mortise, and tongue and groove; and combinations thereof.

13. A molded construction product in accordance with claim 1, wherein said composition matrix has a R factor value in the range of 28 to 68 per hr-ft$^2$-° F./BTU of said composite material composition.

14. A molded construction product in accordance with claim 1, wherein said composition matrix has a CSW ratio value of at least 95,000 psi/pound of said composite material composition.

15. A molded construction product in accordance with claim 1, wherein said molded product is selected from the group consisting of foundations, building pads, interior wall erecting panels, exterior wall panels, facade facings, roofing panels, mortarless building blocks, columns, conduits, sewage piping, manholes, manhole covers, septic tanks, insulation barriers, fire rated acoustical panels, power transmission poles, utility poles, overhead lighting poles, heavy timbers, infrastructure piping, railroad ties, piers/docks, pylons, dolphins, chemical storage tanks, streets, walkways, fencing, outdoor benches and tables, and playground equipment.

16. A molded construction product in accordance with claim 1, wherein said molded product is cast from a molding tool.

17. A molded construction product, having one or more walls and an inner core section, comprising:

a) a composition matrix including a resin system, a catalytic agent, a foam core system for said inner core section, a curing agent and a drying agent;

b) said resin system for providing mechanical and physical characteristics of hardness and rigidity to said walls of said molded product, said resin system having a range of 5.00% to 60.0% by weight of said composite material composition;

c) said catalytic agent for activating the reaction for the polymerization of said resin system, said catalytic agent having a range of 0.50% to 30.00% by weight of said composite material composition;

d) said foam core system for producing said inner core section having three-dimensional cross-linking and a core density of 3.5 pounds per cubic foot, said foam core system having a range of 5.0% to 70.0% by weight of said composite material composition;

e) said curing agent for cross-linking of polymers within said resin system for forming said walls to be hard, rigid, and infusible, said curing agent having a range of 10 ppm to 3.00% by weight of said composite material composition; and f) said drying agent for drying and binding of excessive moisture within said composite material composition; said drying agent having a range of 10 ppm to 10.00% by weight of said composition.

18. A molded construction product in accordance with claim 17, wherein said resin system includes chemical compounds selected from the group consisting of polyesters, polystyrenes, polyethylenes, polycarbonates and other polymers and copolymers of ethylene, and styrene 1,2,4-trimethylbenzene.

19. A molded construction product in accordance with claim 17, wherein said catalytic agent includes chemical compounds selected from the group consisting of sodium chloride, methyl ethyl ketone, methyl ethyl ketone peroxide, and potassium acetate.

20. A molded construction product in accordance with claim 17, wherein said resin system further includes filler compounds that act as a reinforcing agent which imparts to said composition matrix stiffness and rigidity, said filler compounds having a range of 5.00% to 80.0% by weight of said composite material composition.

21. A molded construction product in accordance with claim 20, wherein said filler compounds are selected from the group consisting of calcium carbonate, fly ash, fiberglass fibers, sand, coloring agents and combinations thereof.

22. A molded construction product in accordance with claim 20, wherein said filler compounds in conjunction with said resin system form a replicate custom surface for one or more of said exterior walls.

23. A molded construction product in accordance with claim 22, wherein said replicate custom surface is selected from the group consisting of wood, brick, cinder block, stone, cement, metal finishes, ceramic tile, stucco, roof shingles, siding and marble flooring.

24. A molded construction product in accordance with claim 17, wherein said foam core system includes chemical compounds selected from the group consisting of 4,4'-diphenylmethane diisocyanate; 3,3'-dimethoxydiphenylmethane-4,4' diisocyanate; polyhydroxypolyesters; and polyol urethane resins.

25. A molded construction product in accordance with claim 17, wherein said curing agent is selected from the group consisting of tertiary amines, permethylated diethylene triamine, and dylene.

26. A molded construction product in accordance with claim 17, wherein said drying agent is selected from the group consisting of cobalt 6% naphthenate, calcium chloride, and polyamide imides penteneoxide polyphenylene.

27. A molded construction product in accordance with claim 17, further including a structural reinforcement support system for reinforcing the structural integrity of said composition matrix of said composite material composition.

28. A molded construction product in accordance with claim 27, wherein said structural reinforcement support system includes structural components selected from the group consisting of fiberglass rovings, fiberglass string, fiberglass rods, fiberglass fibers, fiberglass matting, steel and iron rebar, steel and iron rods, metal wiring, plastic rods, plastic strips, woven wire mesh, steel wool, metal cable, braided wiring, ceramic fibers, and combinations thereof.

29. A molded construction product in accordance with claim 17, further including a locking system for joining together one or more of said molded products.

30. A molded construction product in accordance with claim 29, wherein said locking system includes locking mechanisms selected from the group consisting of cam lock systems; snap lock systems; slip fit lock systems; a track and ball lock system; a tension bolt and rod lock system; a hook bolt lock system; friction lock systems including lap joints, lap splices, lap splice joints, ball joint attachments, dove tail joints, dowel joints, pin fitting joints, compression fitting joints, tenon and mortise, and tongue and groove; and combinations thereof.

31. A molded construction product in accordance with claim 17, wherein said composition matrix has a R factor value in the range of 28 to 68 per hr-ft$^2$-° F./BTU of said composite material composition.

32. A molded construction product in accordance with claim 17, wherein said composition matrix has a CSW ratio value of at least 95,000 psi/pound of said composition material composition.

33. A molded construction product in accordance with claim 17, wherein said molded product is selected from the group consisting of foundations, building pads, interior wall erecting panels, exterior wall panels, facade facings, roofing panels, mortarless building blocks, columns, conduits, sewage piping, manholes, manhole covers, septic tanks, insulation barriers, fire rated acoustical panels, power transmission poles, utility poles, overhead lighting poles, heavy timbers, infrastructure piping, railroad ties, piers/docks, pylons, dolphins, chemical storage tanks, streets, walkways, fencing, outdoor benches and tables, and playground equipment.

34. A molded construction product in accordance with claim 17, wherein said molded product is cast from a molding tool.

* * * * *